US011467523B2

(12) United States Patent
Nakai

(10) Patent No.: US 11,467,523 B2
(45) Date of Patent: Oct. 11, 2022

(54) IMAGE FORMING APPARATUS THAT CALCULATES INCLINATION OF APPROXIMATE STRAIGHT LINE, APPROXIMATING RELATION BETWEEN TONER DENSITY AND DEVELOPING CURRENT, USING DIFFERENT MATHEMATICAL EXPRESSIONS DEPENDING ON WHETHER THREE TONER PATCHES OR FOUR OR MORE TONER PATCHES ARE PROVIDED

(71) Applicant: KYOCERA Document Solutions Inc., Osaka (JP)

(72) Inventor: Jun Nakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/529,733

(22) Filed: Nov. 18, 2021

(65) Prior Publication Data

US 2022/0163914 A1 May 26, 2022

(30) Foreign Application Priority Data

Nov. 26, 2020 (JP) ..... JP2020-195951

(51) Int. Cl.
*G03G 15/00* (2006.01)
*G03G 15/06* (2006.01)

(52) U.S. Cl.
CPC ..... *G03G 15/5058* (2013.01); *G03G 15/065* (2013.01); *G03G 15/5037* (2013.01); *G03G 15/5041* (2013.01)

(58) Field of Classification Search
CPC ..... G03G 15/065; G03G 15/5041; G03G 15/5037; G03G 15/5058
See application file for complete search history.

(56) References Cited

U.S. PATENT DOCUMENTS

2011/0221847 A1* 9/2011 Takezawa ..... G03G 15/043 347/118
2018/0052413 A1* 2/2018 Toyofuku ..... G03G 15/0189
2019/0049872 A1* 2/2019 Mori ..... G03G 15/0855

FOREIGN PATENT DOCUMENTS

JP 2010-019969 A 1/2010

* cited by examiner

*Primary Examiner* — Carla J Therrien
(74) *Attorney, Agent, or Firm* — IP Business Solutions, LLC

(57) ABSTRACT

An image forming apparatus includes a developing roller, a photoconductor drum, a density detector, a current detector, and a controller. The developing roller carries a toner. The photoconductor drum carries a toner patch. The density detector detects toner density of the toner patch. The current detector detects developing current flowing to the toner patch. The controller calculates an inclination of an approximate straight line approximating a relation between the toner density and the developing current. The developing roller develops three or more toner patches, different in toner density and different in developing current from one another, on the photoconductor drum. The controller calculates the inclination, using different mathematical expressions depending on whether three toner patches or four toner patches are provided.

7 Claims, 17 Drawing Sheets

IMAGE FORMING APPARATUS THAT CALCULATES INCLINATION OF APPROXIMATE STRAIGHT LINE, APPROXIMATING RELATION BETWEEN TONER DENSITY AND DEVELOPING CURRENT, USING DIFFERENT MATHEMATICAL EXPRESSIONS DEPENDING ON WHETHER THREE TONER PATCHES OR FOUR OR MORE TONER PATCHES ARE PROVIDED

INCORPORATION BY REFERENCE

This application claims priority to Japanese Patent Application No. 2020-195951 filed on Nov. 26, 2020, the entire contents of which are incorporated by reference herein.

BACKGROUND

The present disclosure relates to an image forming apparatus.

A technique to calculate an electrical charge amount of toner is known. The technique includes forming two toner patches on a photoconductor drum, and calculating a ratio of a difference in developing current to a difference in stuck amount of toner, between the two toner patches, in other words the inclination of a straight line representing the developing current relative to the stuck amount of toner.

SUMMARY

The disclosure proposes further improvement of the foregoing technique.

In an aspect, the disclosure provides an image forming apparatus including a developing roller, a photoconductor drum, a density detector, a current detector, and a controller. The developing roller carries a toner. The photoconductor drum carries a toner patch on which an electrostatic latent image has been developed with the toner carried by the developing roller. The density detector detects toner density of the toner patch. The current detector detects developing current flowing to the toner patch. The controller includes a processor, and calculates, when the processor executes a control program, an inclination of an approximate straight line approximating a relation between the toner density and the developing current. The developing roller develops three or more toner patches, different in toner density and different in developing current from one another, on the photoconductor drum. The controller calculates the inclination, using different mathematical expressions depending on whether three toner patches or four or more toner patches are provided.

DETAILED DESCRIPTION

Figure 1:
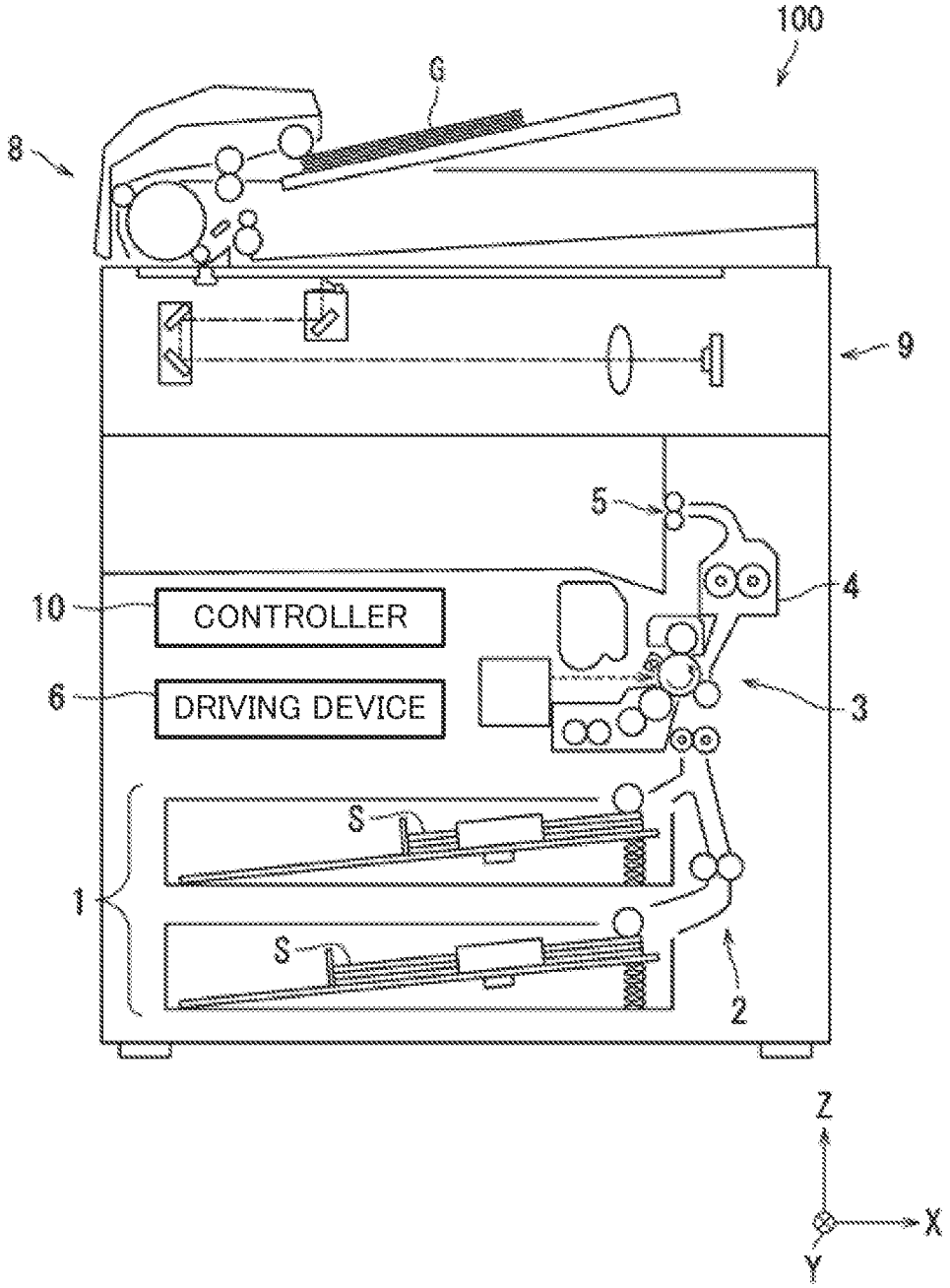
FIG. 1 is a schematic cross-sectional view showing a structure of an image forming apparatus.

Hereafter, some embodiments of the disclosure will be described, with reference to the drawings. In the drawings, the same or corresponding elements are given the same numeral, and the description thereof will not be repeated. In FIG. 1, an X-axis, a Y-axis, and a Z-axis, which are orthogonal to one another, are indicated. The Z-axis is parallel to a vertical plane. The X-axis and the Y-axis are parallel to a horizontal plane.

First Embodiment

Figure 2:
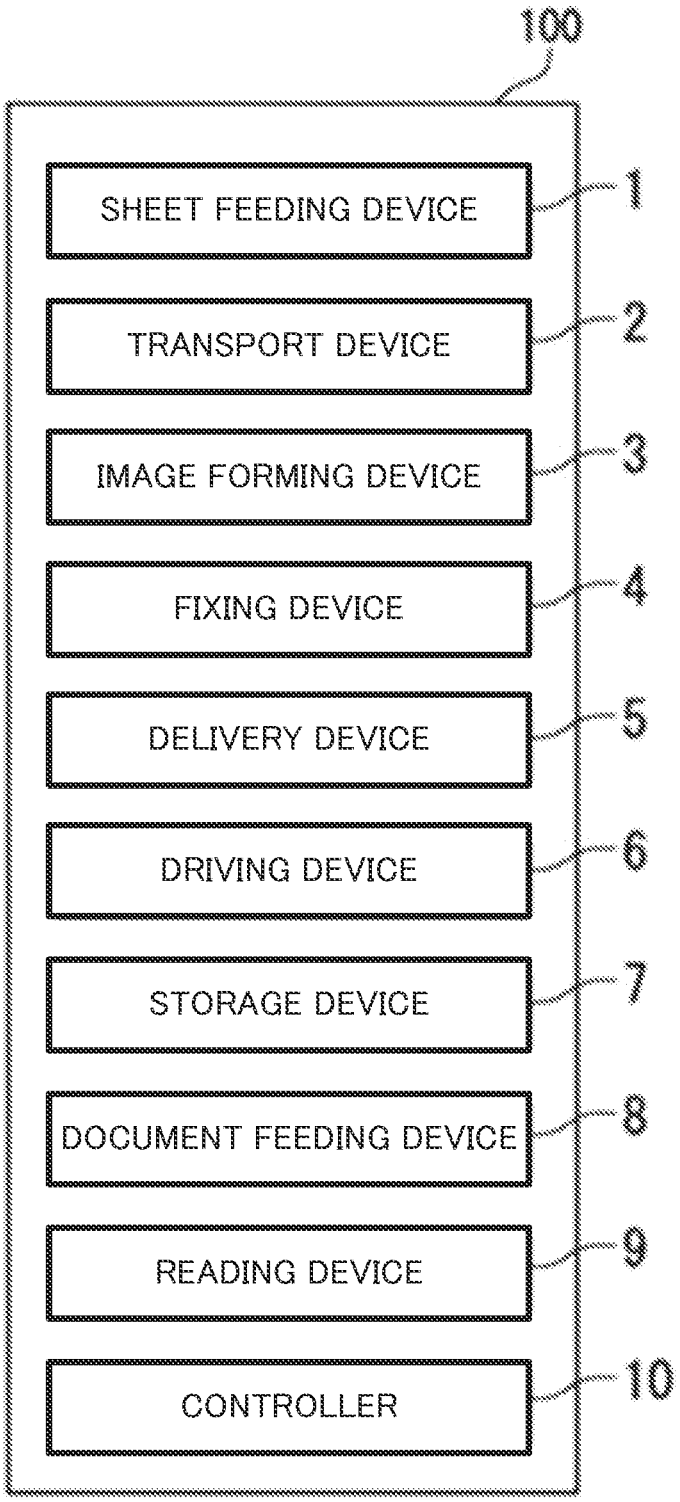
FIG. 2 is a block diagram showing an internal configuration of the image forming apparatus.

Referring to FIG. 1 and FIG. 2, an image forming apparatus 100 according to a first embodiment of the disclosure will be described. FIG. 1 is a schematic cross-sectional view showing the configuration of the image forming apparatus 100. FIG. 2 is a block diagram showing an internal configuration of the image forming apparatus 100.

As shown in FIG. 1 and FIG. 2, the image forming apparatus 100 includes a sheet feeding device 1, a transport device 2, an image forming device 3, a fixing device 4, a delivery device 5, a driving device 6, a storage device 7, a document feeding device 8, a reading device 9, and a controller 10. The image forming apparatus 100 is, for example, a copier, a facsimile machine, or a multifunction peripheral having a plurality of such functions.

The sheet feeding device 1 feeds sheets S. The sheet feeding device 1 includes a tray and a pickup roller. On the tray, the sheets S are stacked. The pickup roller picks up and feeds the sheet S from the tray.

The transport device 2 transports the sheet S delivered from the sheet feeding device 1. The transport device 2 includes a transport route. The transport route extends from the sheet feeding device 1 as the start point, as far as the delivery device 5, by way of the image forming device 3 and the fixing device 4. The transport device 2 includes a plurality of transport rollers and a resist roller, provided on the transport route.

The plurality of transport rollers serve to transport the sheet S along the transport route. The resist roller adjusts the timing for delivering the sheet S to the image forming device 3. The transport device 2 transports the sheet S from the sheet feeding device 1 as far as the delivery device 5, by way of the image forming device 3 and the fixing device 4.

The image forming device 3 forms a toner image on the sheet S on the basis of image data, by electrophotography. The image data represents, for example, the image of a source document G. The sheet S on which the toner image has been formed by the image forming device 3 is transported to the fixing device 4. Further details of the image forming device 3 will be subsequently described, with reference to FIG. 3.

The fixing device 4 heats and presses the toner image formed on the sheet S, thereby fixing the toner image onto the sheet S.

The delivery device 5 delivers the sheet S to outside of the casing of the image forming apparatus 100. The delivery device 5 includes a delivery roller and an output tray. The delivery roller delivers the sheet S transported by the transport roller from the fixing device 4, to the output tray. The delivered sheets S are stacked on the output tray.

The driving device 6 is an actuator that supplies driving force to the mechanisms of the image forming apparatus 100, namely the sheet feeding device 1, the transport device 2, the image forming device 3, the fixing device 4, and the delivery device 5. The driving device 6 can be typically exemplified by a motor.

The storage device 7 contains programs, mathematical expression data, and other types of data. In the storage device 7, a processing result of the controller 10 may be temporarily stored. The storage device 7 may include a desired memory unit, such as a semiconductor storage device, or a magnetic storage device. The storage device 7 may include a combination of a portable storage medium such as a memory card, and a reading device of the storage medium. The storage device 7 can be exemplified by a read-only memory (ROM), or a random-access memory (RAM).

The programs stored in the storage device 7 includes applications to be executed on the foreground or background, and control programs that support the operation of the application. The control program can be exemplified by an operating system (OS).

The storage device 7 may further be constituted as a tangible, computer-readable carrier (medium), for example formed of a solid-state memory, a magnetic disk, or an optical disk. In such a medium, sets of computer commands such as a program module, and data structure, for causing the processor to execute the operation according to the first embodiment, may be stored.

Examples of the computer-readable medium include an electrical connection having one or more wirings, a magnetic disk storage medium, a magnetic cassette, a magnetic tape, and other magnetic or optical storage devices (e.g., a compact disk (CD), a laser disk (registered trademark), a digital versatile disc (DVD, registered trademark), a floppy disk (registered trademark), and a Blu-ray disk (registered trademark)), a portable computer disk, a RAM, a ROM, a rewritable and programmable ROM such as an erasable programmable read-only memory (EPROM), an electrically erasable programmable read-only memory (EEPROM, registered trademark), or a flash memory, other tangible storage media capable of storing information therein, and a combination of two or more of the cited materials. The memory unit may be provided at least one of inside and outside of a processor or a processing unit.

The document feeding device 8 transports, for example the source document G, to the reading device 9. The document feeding device 8 can be exemplified by an automatic document feeder (ADF).

The reading device 9 reads the image of the source document G transported by the document feeding device 8. The reading device 9 generates the image data representing the image that has been read. The reading device 9 can be exemplified by a scanner including a contact image sensor (CIS) or a charge-coupled device (CCD) sensor.

The controller 10 controls the overall operations of the image forming apparatus 100. The controller 10 includes a central processing unit (CPU), a ROM, a RAM, and so forth.

The CPU is a processor that executes various types of computation. The ROM is a non-volatile storage device, in which information such as control programs for causing the CPU to execute various processings is stored in advance. The RAM is a volatile or non-volatile storage device, to be utilized as a temporary memory (operating region) for the processings executed by the CPU.

The processor of the controller 10 controls the operation of each of the components of the image forming apparatus 100, by executing the computer program stored in the storage device 7 or the ROM.

To be more detailed, the processor of the controller 10 controls the operation of the sheet feeding device 1, the transport device 2, the image forming device 3, the fixing device 4, the delivery device 5, the driving device 6, the storage device 7, the document feeding device 8, and the reading device 9, by executing the computer program stored in the storage device 7 or the ROM.

Figure 3:
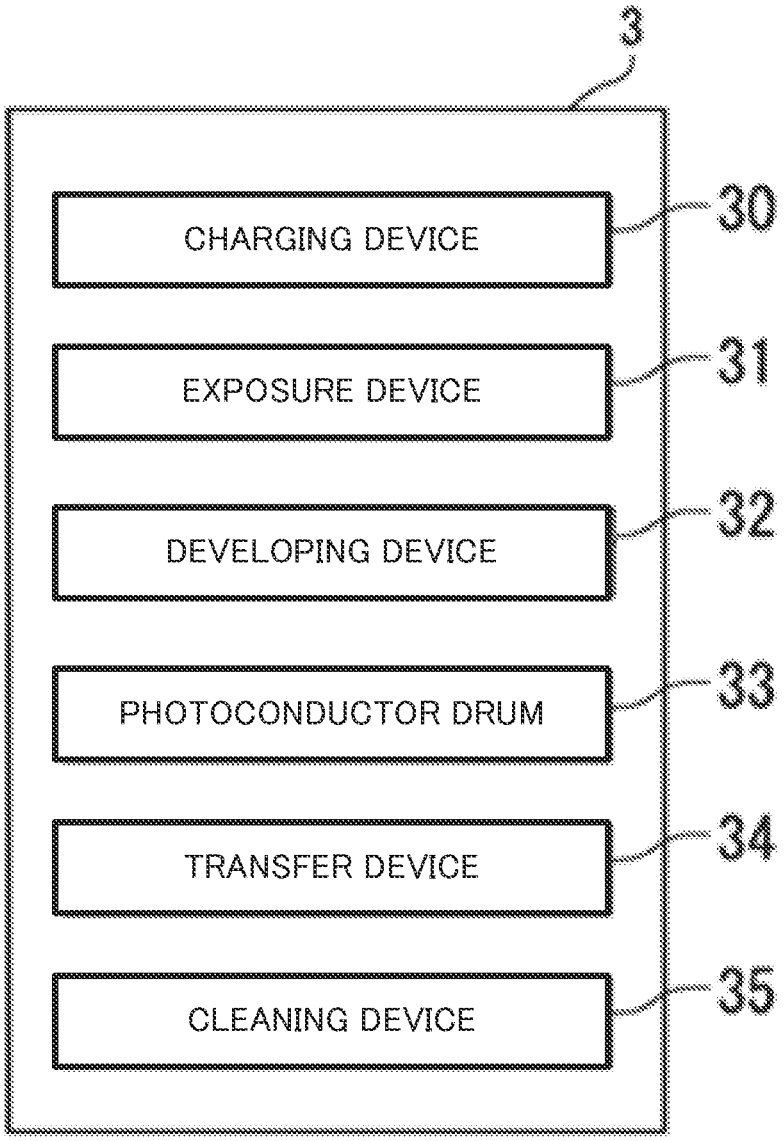
FIG. 3 is a block diagram showing a configuration of an image forming device.
Figure 4:
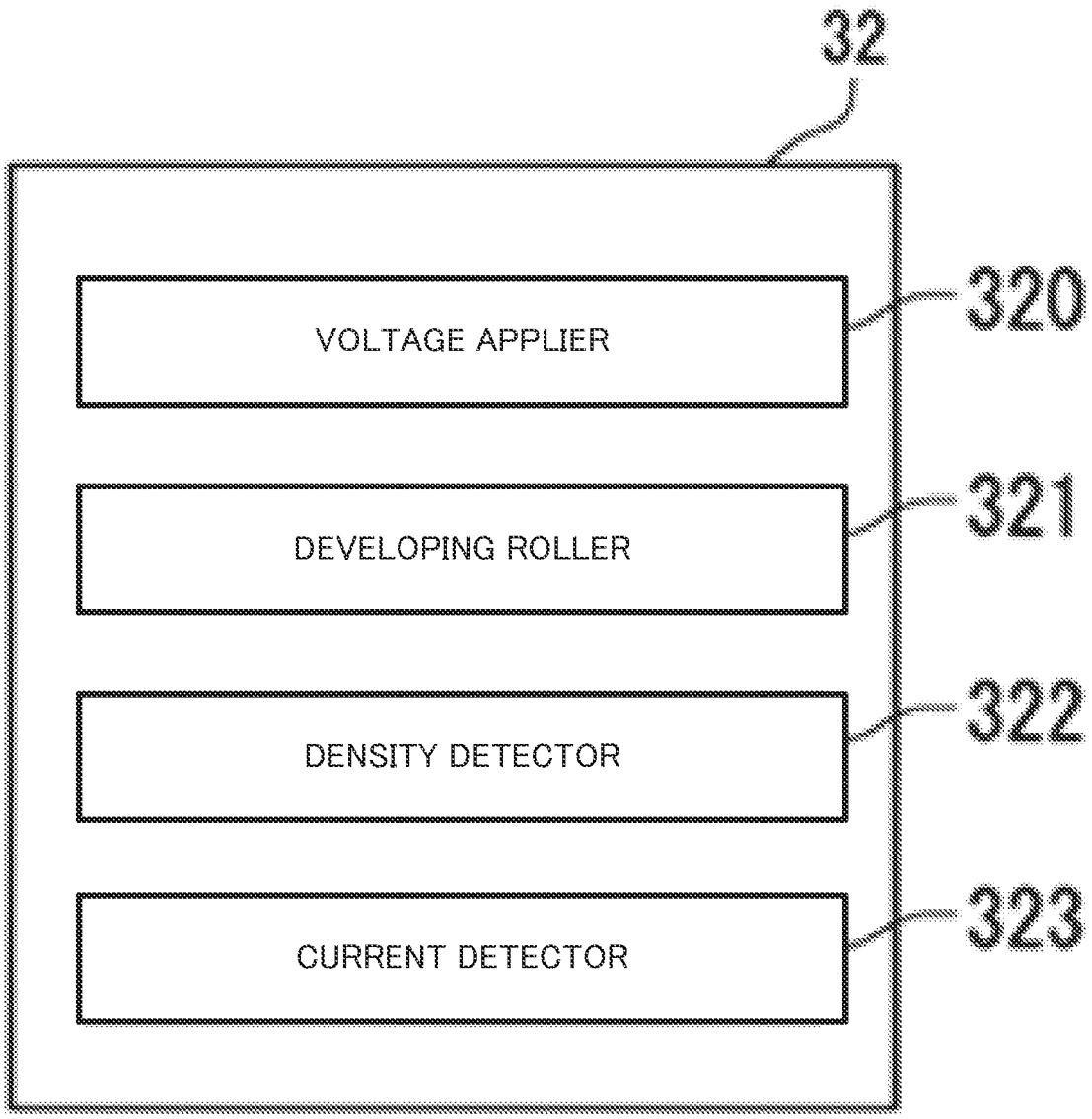
FIG. 4 is a block diagram showing a configuration of a developing device.
Figure 5:
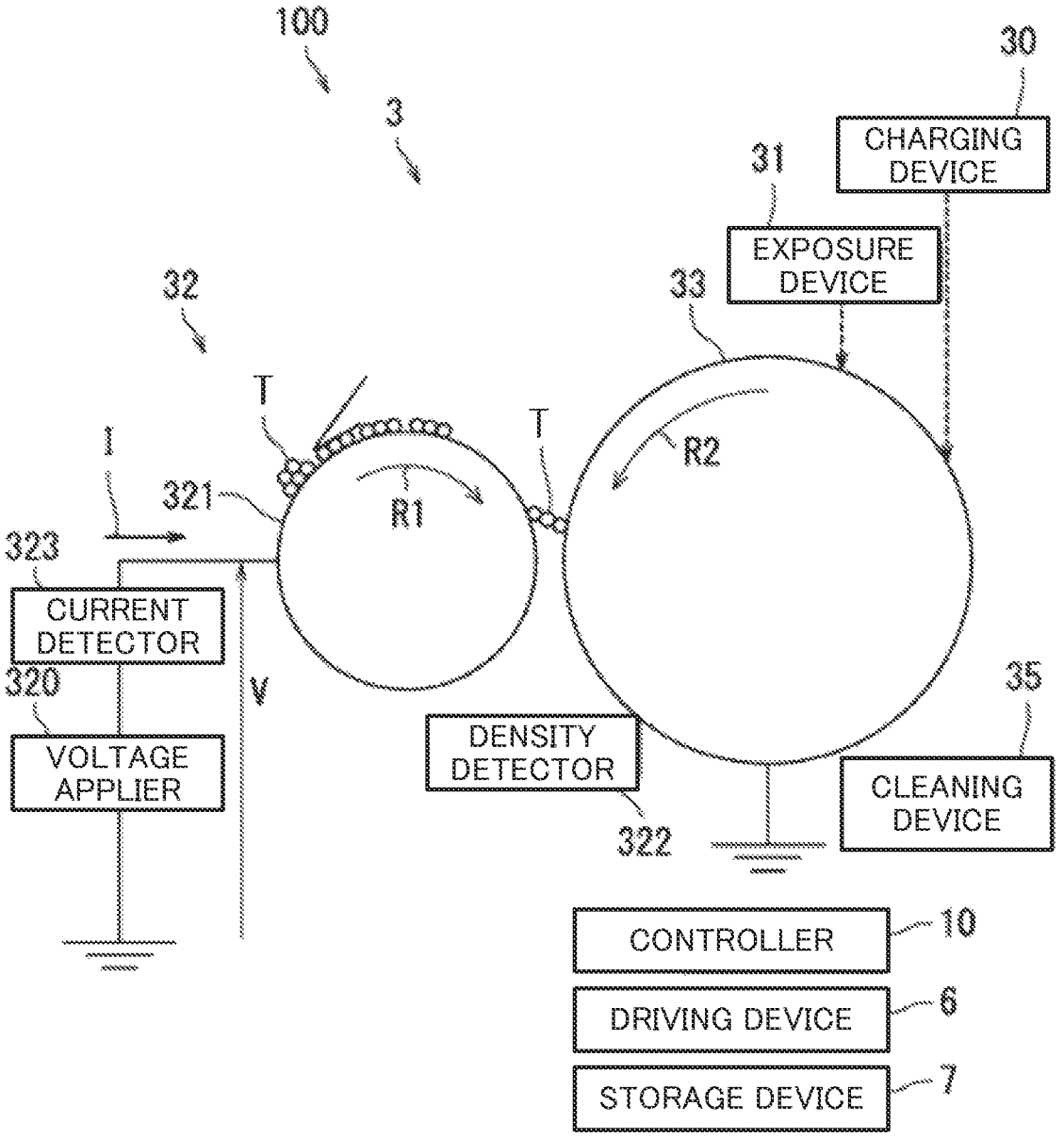
FIG. 5 is a schematic drawing showing the configuration of the developing device.

Referring to FIG. 3 to FIG. 7, in addition to FIG. 1 and FIG. 2, a configuration of the image forming device 3 and the developing device 32, a toner patch P, and an approximate straight line will be described hereunder. FIG. 3 is a block diagram showing the configuration of the image forming device 3. FIG. 4 is a block diagram showing the configuration of the developing device 32. FIG. 5 is a schematic drawing showing the configuration of the developing device.

Referring to FIG. 3 to FIG. 5, the image forming device 3 will be described. As shown in FIG. 3 and FIG. 5, the image forming device 3 includes a charging device 30, an exposure device 31, a developing device 32, a photoconductor drum 33, a transfer device 34, and a cleaning device 35.

The charging device 30 electrically charges the photosensitive layer of the photoconductor drum 33, to a predetermined potential. The charging device 30 may charge the photoconductor drum 33 by non-contact charging using a corona charger having a grid (scorotron charger), or by contact charging using a rubber roller.

The exposure device 31 irradiates the photosensitive layer of the photoconductor drum 33 with a laser beam. The exposure device 31 exposes the photoconductor drum 33 to the laser beam, according to the image data. As result, an electrostatic latent image is formed on the surface of the photoconductor drum 33.

The developing device 32 contains, for example, a two-component developing agent including a magnetic carrier and toner T. The developing device 32 develops the electrostatic latent image formed on the photoconductor drum 33, with the toner T, thereby forming a toner image on the surface of the photoconductor drum 33. Further detail of the developing device 32 will be subsequently described, with reference to FIG. 4.

The photoconductor drum 33 is a drum having a rotation shaft. The photoconductor drum 33 rotates about the rotation shaft. The photoconductor drum 33 carries the toner image (e.g., toner patch P), developed from the electrostatic latent image with the toner T carried by a developing roller 321 shown in FIG. 4. The photoconductor drum 33 can be exemplified by an organic photoconductor (OPC) drum.

The transfer device 34 includes a transfer roller, and an intermediate transfer belt. The transfer roller transfers the toner image on the photoconductor drum 33, to the intermediate transfer belt, or the sheet S.

The cleaning device 35 removes the toner T remaining on the photoconductor drum 33 after the transfer. The cleaning device 35 includes, for example, a cleaning blade.

The developing device 32 will be described in detail, with reference to FIG. 4. As shown in FIG. 4, the developing device 32 includes a voltage applier 320, the developing roller 321, a density detector 322, and a current detector 323.

The voltage applier 320 applies a developing bias voltage V to the developing roller 321. The developing roller 321 carries the toner T.

The density detector 322 detects toner density M of the toner patch P The density detector 322 can be exemplified by a toner density sensor.

The current detector 323 detects developing current I flowing to the toner patch P The current detector 323 may be constituted of, for example, an application-specific integrated circuit (ASIC). The developing current I varies depending on the toner density M. The current detector 323 detects the value of the developing current I that varies depending on the toner density M of the toner patch P formed on the photoconductor drum 33.

Referring now to FIG. 5, the configuration of the image forming device 3 will be described in further detail.

As shown in FIG. 5, the controller 10 controls at least the driving device 6, the charging device 30, the exposure device 31, the developing device 32, the photoconductor drum 33, and the transfer device 34 and the cleaning device 35 shown in FIG. 3.

The controller 10 also controls at least the voltage applier 320, the developing roller 321, the density detector 322, and the current detector 323 of the developing device 32.

The driving device 6 drives the developing roller 321 and the photoconductor drum 33. The charging device 30 electrically charges the circumferential surface of the photoconductor drum 33. The exposure device 31 irradiates the circumferential surface of the photoconductor drum 33 with the laser beam, according to the image data.

The voltage applier 320 is connected to the developing roller 321. As described above, the voltage applier 320 applies the developing bias voltage V corresponding to the density of the toner image, to the developing roller 321.

The developing roller 321 rotates in a direction R1. The photoconductor drum 33 rotates in a direction R2. The developing roller 321 and the photoconductor drum 33 are located such that the respective circumferential surfaces are opposed to each other. The developing roller 321 develops three or more toner patches P, different in toner density M and different in developing current I from one another, on the photoconductor drum 33.

When the circumferential surface of the developing roller 321 and the circumferential surface of the photoconductor drum 33 come close to each other, the toner T on the developing roller 321 flies to the electrostatic latent image on the photoconductor drum 33, according to the developing bias voltage V of the developing roller 321. The electrostatic latent image on the photoconductor drum 33 is developed with the toner T, to the density corresponding to the developing bias voltage V.

To the developing roller 321, the developing current I corresponding to the developing bias voltage V flows.

The current detector 323 measures the developing current I. The developing current I flows through the developing roller 321 to the photoconductor drum 33.

The density detector 322 is located close to the photoconductor drum 33, to detect the density of the toner patch P formed on the photoconductor drum 33. The density detector 322 may be located close to the intermediate transfer belt of the transfer device 34, to detect the density of the toner patch P transferred to the intermediate transfer belt.

Thus, the image forming apparatus 100 according to the first embodiment includes the developing roller 321, the photoconductor drum 33, the density detector 322, the current detector 323, and the controller 10.

The controller 10 calculates an inclination "a" of the approximate straight line, approximating the relation between the toner density M and the developing current I. The developing roller 321 develops three or more toner patches P, different in toner density M and in developing current I from one another, on the photoconductor drum 33. The controller 10 calculates the inclination "a" using different mathematical expressions, depending on whether three toner patches P or four toner patches P are provided.

When Three Toner Patches P Are Provided

Figure 6:
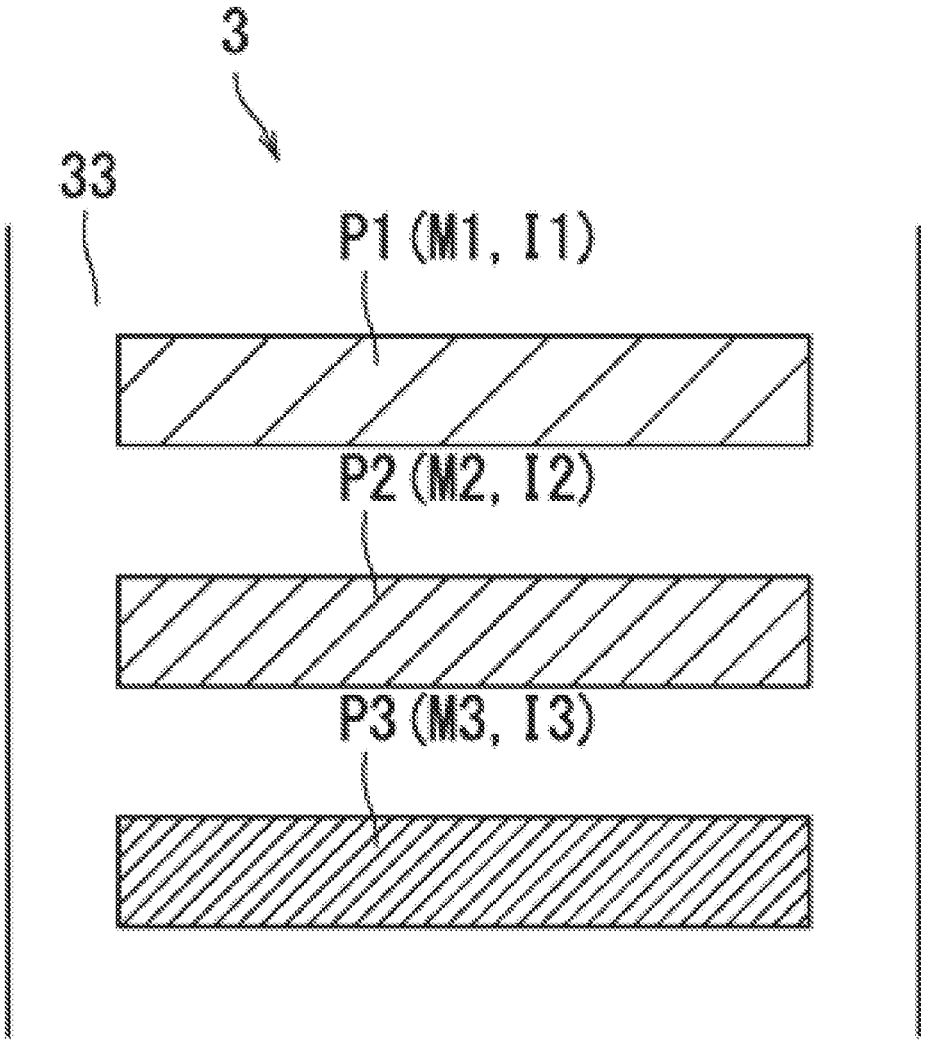
FIG. 6 is a schematic drawing showing three toner patches formed on a photoconductor drum.

FIG. 6 illustrates three toner patches P1, P2, and P3 formed on the photoconductor drum 33. The developing roller 321 forms the toner patch P1, the toner patch P2, and the toner patch P3 as shown in FIG. 6, on the photoconductor drum 33. The three toner patches P1, P2, and P3 are different in toner density M, from one another. When the toner patches P1, P2, and P3 come closest to the developing roller 321, a different developing current I flows to each of the three toner patches P1, P2, and P3.

The toner patch P1 has a toner density M1, and receives a developing current I1. The toner patch P2 has a toner density M2, and receives a developing current I2. The toner patch P3 has a toner density M3, and receives a developing current I3.

Figure 7:
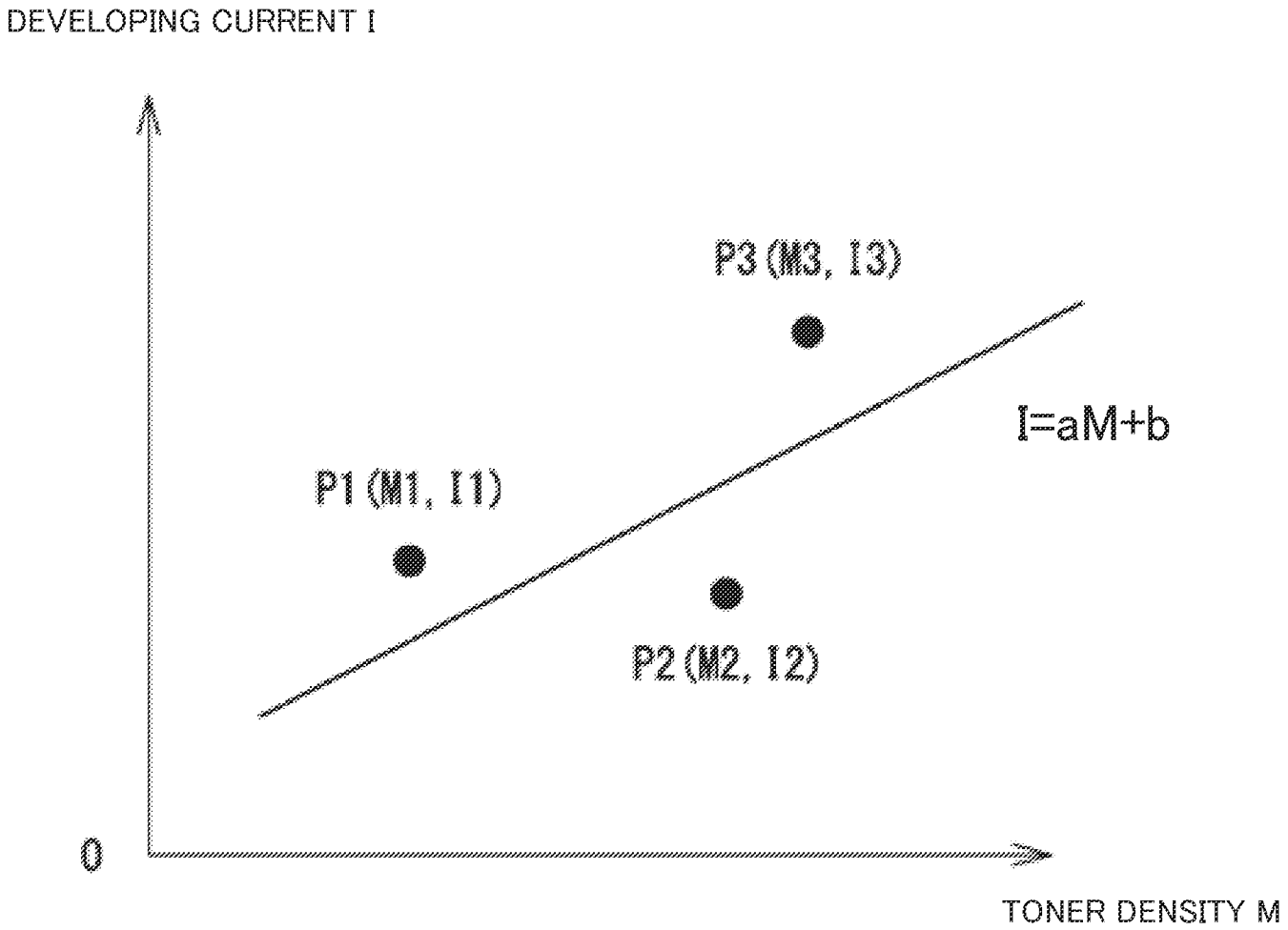
FIG. 7 is a graph showing an approximate straight line related to the three toner patches.

FIG. 7 is a graph showing the approximate straight line representing the relation between the toner density M and the developing current I, with respect to the three toner patches. When the toner density M1 and the developing current I1 related to the toner patch P1, the toner density M2 and the developing current I2 related to the toner patch P2, and the toner density M3 and the developing current I3 related to the toner patch P3 are plotted on an imaginary toner density/developing current plane as shown in FIG. 7, the inclination "a", and the approximate straight line of the developing current segment b (I=aM+b) can be defined.

The controller 10 calculates the inclination "a" of the approximate straight line, approximating the relation between the toner density M and the developing current I. To be more detailed, when three toner patches P are provided, the controller 10 conceives a combination of two toner patches P selected from the toner patches P1, P2, and P3, and substitutes the corresponding toner density M and developing current I into [Math. 1] cited below, thereby calculating the inclination "a" of the approximate straight line approximating the relation between the toner density M and the developing current I. The specific calculation process will be subsequently described, with reference to FIG. 10A.

[Math. 1] (1)

$$a = \frac{\sum_{1 \le i < j \le n} (M_j - M_i)(I_j - I_i)}{\sum_{1 \le i < j \le n} (M_j - M_i)^2}$$

When Four or More Toner Patches P are Provided

The developing roller 321 develops n (n≥4) pieces of toner patches P, different in toner density M and in developing current I from one another, on the photoconductor drum 33.

Figure 8:
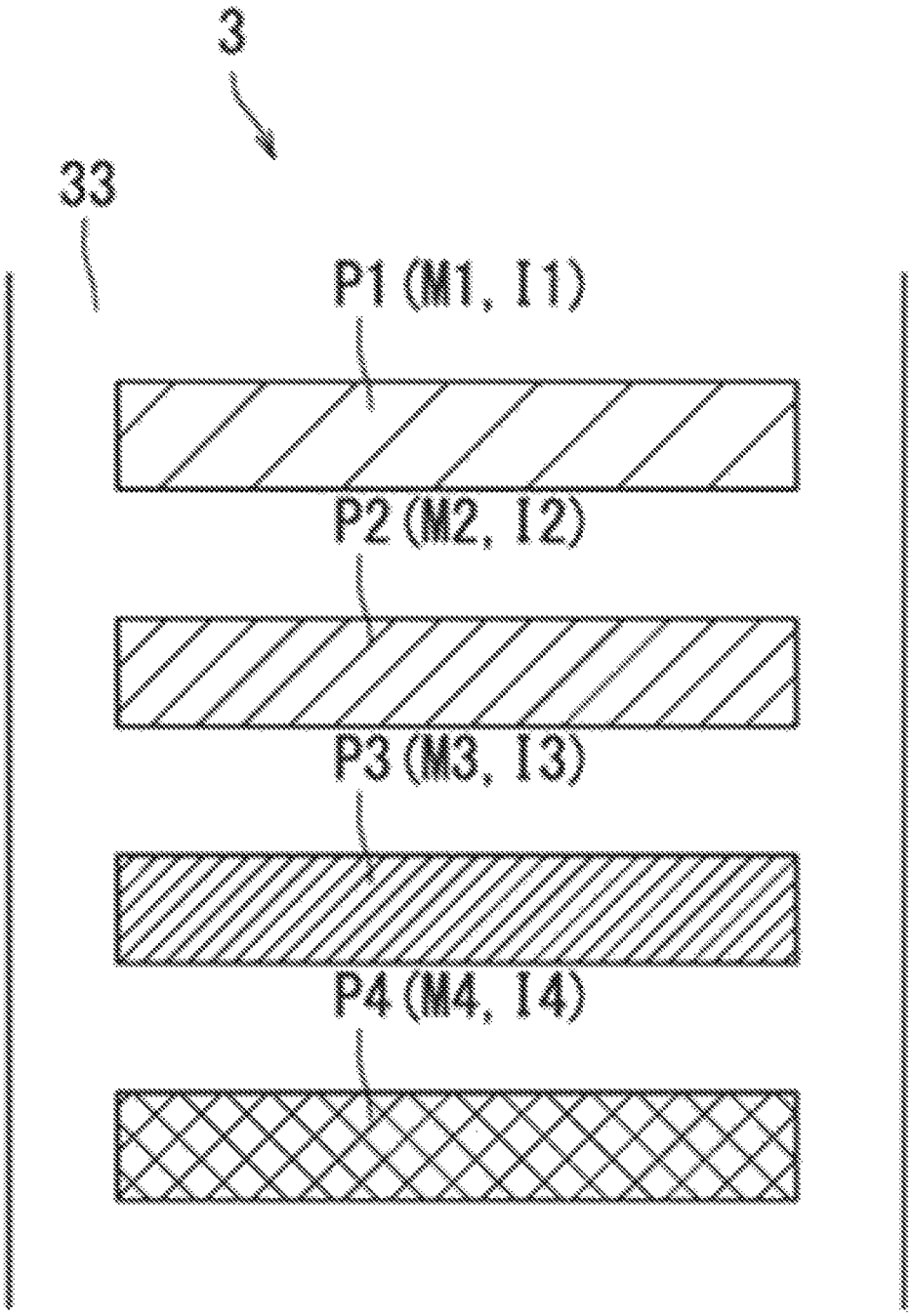
FIG. 8 is a schematic drawing showing four toner patches formed on the photoconductor drum.

FIG. 8 illustrates four toner patches P1, P2, P3, and P4 formed on the photoconductor drum 33. The developing roller 321 forms the toner patch P1, the toner patch P2, the toner patch P3, and the toner patch P4 for example as shown in FIG. 8, on the photoconductor drum 33. The four toner patches P1, P2, P3, and P4 are different in toner density M, from one another. When the toner patches P1, P2, P3, and P4 come closest to the developing roller 321, a different developing current I flows to each of the three toner patches P1, P2, P3, and P4. Here, although FIG. 8 illustrates the four toner patches P1, P2, P3, and P4 as an example, the number of toner patches P is not limited to four. Five or more toner patches P may be formed on the photoconductor drum 33. For the description given hereunder, it will be assumed that n is four.

The toner patch P1 has a toner density M1, and receives a developing current I1. The toner patch P2 has a toner density M2, and receives a developing current I2. The toner patch P3 has a toner density M3, and receives a developing current I3. The toner patch P4 has a toner density M4, and receives a developing current I4.

Figure 9:
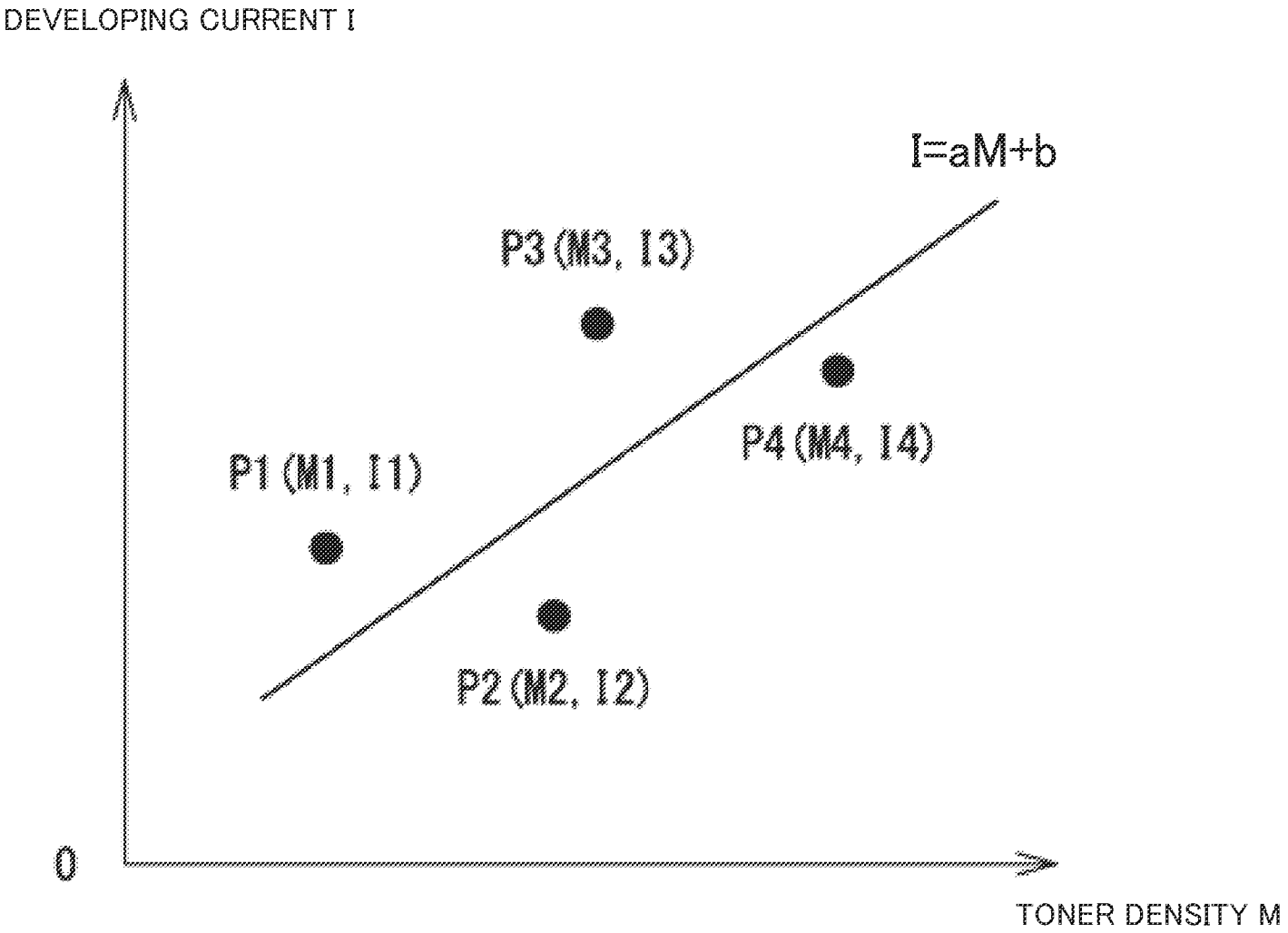
FIG. 9 is a graph showing an approximate straight line related to the four toner patches.

FIG. 9 is a graph showing the approximate straight line representing the relation between the toner density M and the developing current I, with respect to the toner patches P1, P2, P3, and P4. When the toner density M1 and the developing current I1 related to the toner patch P1, the toner density M2 and the developing current I2 related to the toner patch P2, the toner density M3 and the developing current I3 related to the toner patch P3, and the toner density M4 and the developing current I4 related to the toner patch P4 are plotted on the imaginary toner density/developing current plane as shown in FIG. 9, the inclination "a", and the approximate straight line of the developing current segment b (I=aM+b) can be defined.

The inclination "a" represents the charge amount of the toner (Q/M). Calculating the inclination "a" enables the developing current I, required for outputting the desired toner density M, to be obtained. The controller 10 adjusts the developing bias voltage to be applied to the developing roller 321, on the basis of the inclination "a" calculated as above.

When four toner patches P are provided, the controller 10 substitutes the toner density M1 and the developing current I1 related to the toner patch P1, the toner density M2 and the developing current I2 related to the toner patch P2, the toner density M3 and the developing current I3 related to the toner patch P3, and the toner density M4 and the developing current I4 related to the toner patch P4 into [Math. 2] cited below, thereby calculating the inclination "a" of the approximate straight line approximating the relation between the toner density M and the developing current I. The specific calculation process will be subsequently described, with reference to FIG. 10B.

[Math. 2] (2)

$$a = \frac{n\sum_{k=1}^{n} M_k I_k - \sum_{k=1}^{n} M_k \sum_{k=1}^{n} I_k}{n\sum_{k=1}^{n} M_k^2 - \left(\sum_{k=1}^{n} M_k\right)^2}$$

As will be subsequently described, when three toner patches P are provided, the number of times of calculation, or the calculation amount by the controller 10 becomes less, by using [Math. 1] to calculate the inclination "a" of the approximate straight line, than by using [Math. 2].

On the other hand, when four or more toner patches P are provided, the number of times of calculation, or the calculation amount by the controller 10 becomes less, by using [Math. 2] to calculate the inclination "a" of the approximate straight line, than by using [Math. 1].

Therefore, the controller 10 uses the different mathematical expressions to calculate the inclination "a", depending on whether three toner patches P or four or more toner patches P are provided.

Now, in the case of the aforementioned background art, only two toner patches are measured. When only two toner patches are measured, an accidental error of the measured value of the developing current and stuck amount of toner may largely affect the error in the calculation of the inclination of the straight line representing the detection current. In addition, no reference is made in the background art, to the number of times of calculation or calculation amount, required from the calculation formula for obtaining the inclination of the straight line.

With the arrangement according to the first embodiment, in contrast, the number of times of calculation or the calculation amount for obtaining the inclination "a" of the approximate straight line can be reduced, by using the different mathematical expressions depending on whether three toner patches P or four or more toner patches P are provided.

Figure 10A:
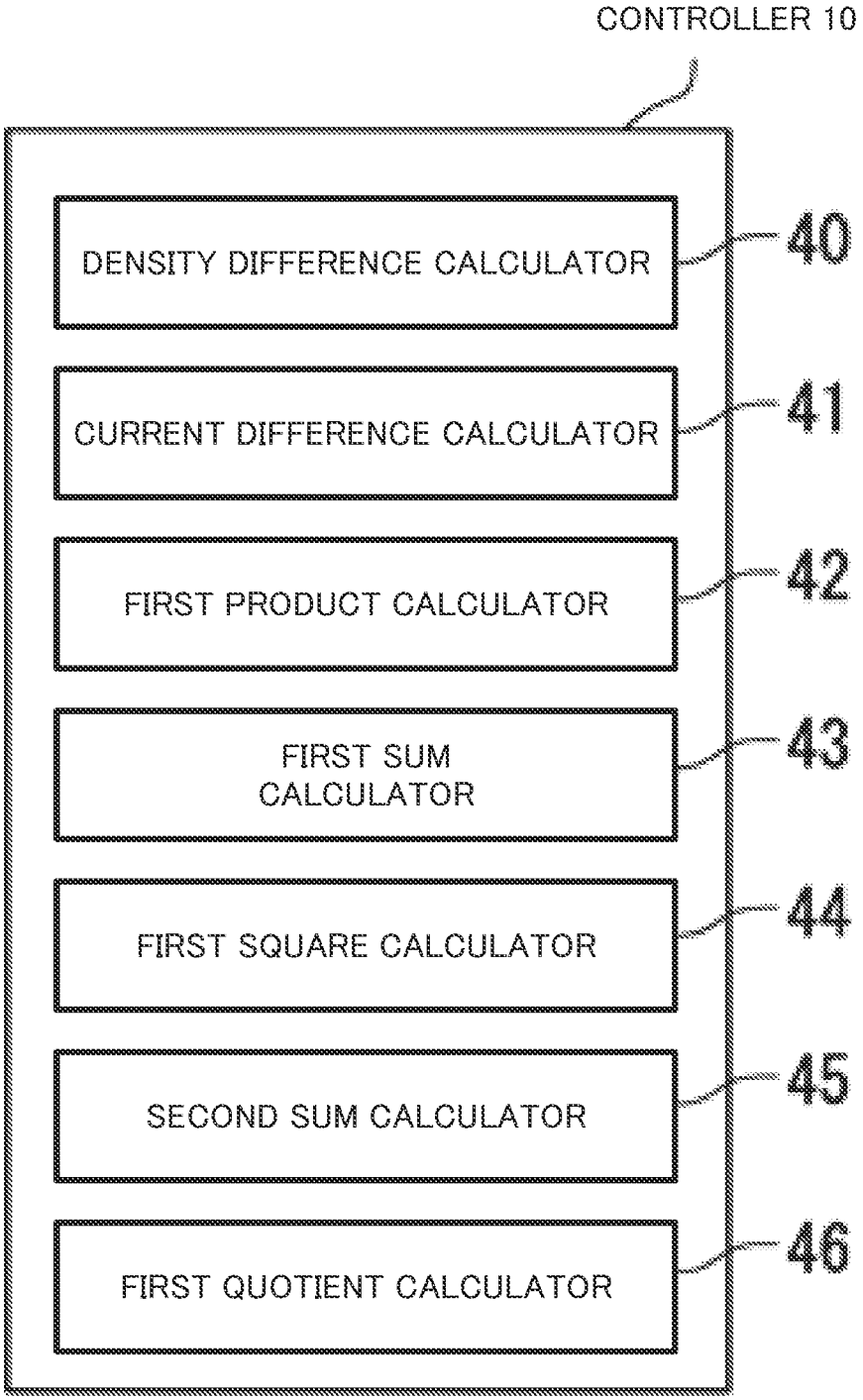
FIG. 10A and FIG. 10B are block diagrams each showing a configuration of a controller according to a first embodiment.
Figure 10B:
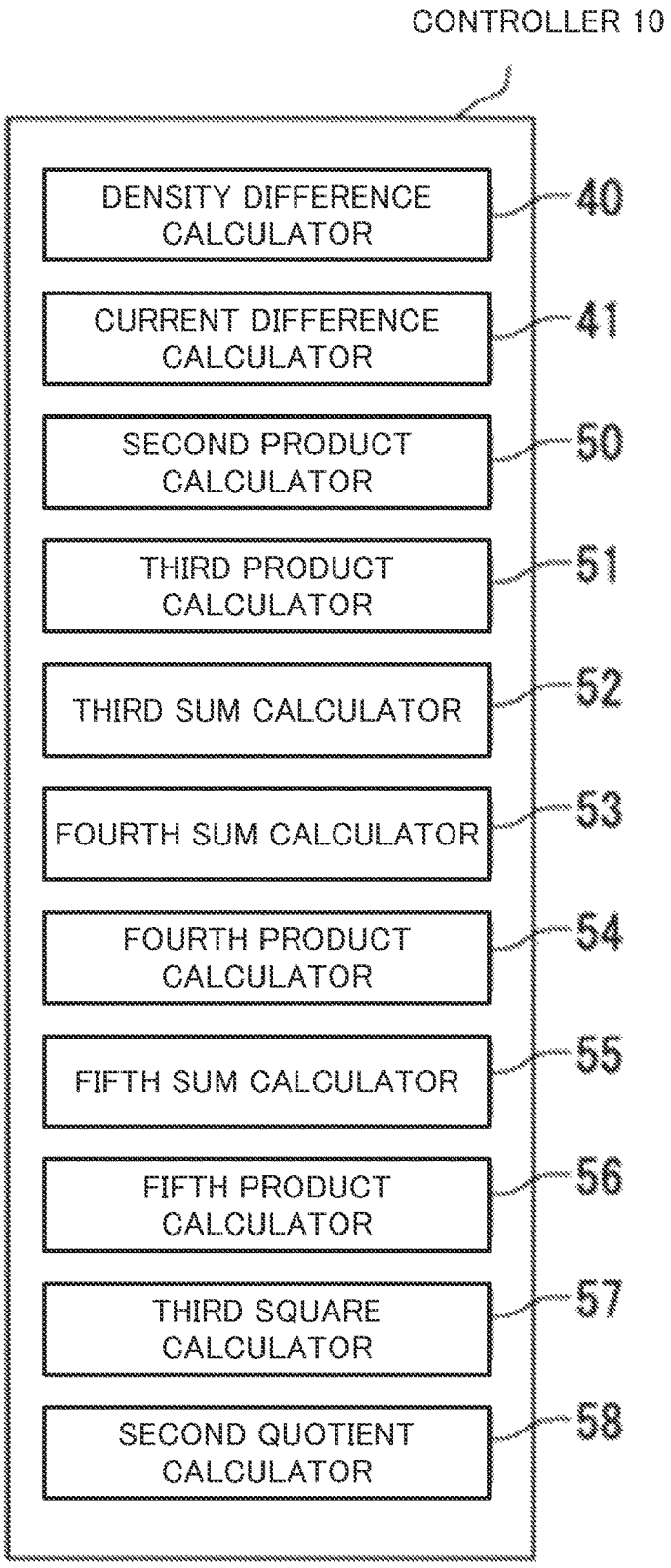

Referring to FIG. 10A and FIG. 10B, an operation of the controller 10 according to the first embodiment will be described hereunder.

When Three Toner Patches P Are Provided

As shown in FIG. 10A the controller 10 according to the first embodiment acts, when the processor executes the control program, as a density difference calculator 40, a current difference calculator 41, a first product calculator 42, a first sum calculator 43, a first square calculator 44, a second sum calculator 45, and a first quotient calculator 46, when three toner patches P are provided.

The developing roller 321 develops the three toner patches P1, P2, and P3, different in toner density M and in developing current I from one another, on the photoconductor drum 33.

The controller 10 calculates the approximate straight line indicating the relation between the toner density M and the developing current I (I=aM+b), on the basis of the three toner patches P1, P2, and P3. The controller 10 determines the inclination "a" of the approximate straight line, using [Math. 3] cited below. [Math. 3] may be stored in advance in the storage device 7. More specifically, [Math. 3] can be made out by substituting the toner density M1 and the developing current I1 related to the toner patch P1, the toner density M2 and the developing current I2 related to the toner patch P2, and the toner density M3 and the developing current I3 related to the toner patch P3, into [Math. 1].

[Math. 3] (3)

$$a = \frac{(M_2 - M_1)(I_2 - I_1) + (M_3 - M_2)(I_3 - I_2) + (M_3 - M_1)(I_3 - I_1)}{(M_2 - M_1)^2 + (M_3 - M_2)^2 + (M_3 - M_1)^2}$$

Hereunder, [Math. 3] (i.e., [Math. 1]) will be sequentially explained.

Numerator of [Math. 3]

The density difference calculator 40 calculates a toner density difference, with respect to each of the combinations of two toner patches P, out of the three toner patches P1, P2, and P3. More specifically, the density difference calculator 40 calculates as follows:

Toner density difference=(toner density$M2$−toner density$M1$)

Toner density difference=(toner density$M3$−toner density$M2$)

Toner density difference=(toner density$M3$−toner density$M1$)

The current difference calculator 41 calculates a current difference between the developing currents I, with respect to each of the combinations of two toner patches P More specifically, the current difference calculator 41 calculates as follows:

Current difference=(developing current$I2$−developing current$I1$)

Current difference=(developing current$I3$−developing current$I2$)

Current difference=(developing current$I3$−developing current$I1$)

The first product calculator 42 calculates a first product, by multiplying the toner density difference by the current difference, with respect to each of the combinations of the toner density difference and the current difference, calculated from each of the combinations of the two toner patches P referred to above. More specifically, the first product calculator 42 calculates as follows:

First product=(toner density$M2$−toner density$M1$)×(developing currentI2−developing current$I1$)

First product=(toner density$M3$−toner density$M2$)×(developing currentI3−developing current$I2$)

First product=(toner density$M3$−toner density$M1$)×(developing currentI3−developing current$I1$)

The first sum calculator 43 calculates a first sum, by summing up the three values of the first product calculated as above. More specifically, the first sum calculator 43 calculates as follows:

First sum=(toner density$M2$−toner density$M1$)×(developing current$I2$−developing current$I1$)+(toner density$M3$−toner density$M2$)×(developing current$I3$−developing current$I2$)+(toner density$M3$−toner density$M1$)×(developing current$I3$−developing current$I1$)

Denominator of [Math. 3]

The first square calculator 44 calculates a first square indicating the square of the toner density difference, with respect to each of the combinations of the two toner patches P. More specifically, the first square calculator 44 calculates as follows:

First square=(toner density$M2$−toner density$M1$)$^2$

First square=(toner density$M3$−toner density$M2$)$^2$

First square=(toner density$M3$−toner density$M1$)$^2$

The second sum calculator 45 calculates a second sum, by summing up the three values of the first square calculated as above. More specifically, the second sum calculator 45 calculates as follows:

Second sum=(toner density$M2$−toner density$M1$)$^{2+}$ (toner density$M3$−toner density$M2$)$^{2+}$ (toner density$M3$−toner density$M1$)$^2$ Inclination "a" of Approximate Straight Line The first quotient calculator 46 calculates a first quotient, by dividing the first sum by the second sum. In other words, the first quotient calculator 46 calculates as follows:

First quotient=(first sum)/(second sum)

To be more detailed, the first quotient calculator 46 calculates as follows:

First quotient=[(toner density$M2$−toner density$M1$)×(developing current$I2$−developing current$I1$)+(toner density$M3$−toner density$M2$)×(developing current$I3$−developing current$I2$)+(toner density$M3$−toner density$M1$)×(developing current$I3$−developing current$I1$)]/[(toner density$M2$−toner density$M1$)$^{2+}$ (toner density$M3$−toner density$M2$)$^{2+}$ (toner density$M3$−toner density$M1$)$^2$]

Thus, the first quotient calculator 46 calculates the first quotient, indicating the inclination "a" ([Math. 3]) of the approximate straight line approximating the relation among the three points plotted on the toner density/developing current plane, respectively representing the toner density M1 to M3 and the developing current I1 to 13 related to the three toner patches P1, P2, and P3.

With the arrangement according to the first embodiment, the inclination "a" of the approximate straight line, indicating the relation of the developing current I to the toner density M, can be calculated, using the three toner patches P1, P2, and P3.

Here, the advantage from calculating the inclination "a" of the approximate straight line using [Math. 1], when three toner patches P are provided, will be subsequently described, in the paragraphs of "Comparison Between [Math. 1] and [Math. 2]".

When Four or More Toner Patches Are Provided

When four or more toner patches P are provided, the controller 10 calculates the inclination "a" of the approximate straight line indicating the relation of the developing current I to the toner density M, using [Math. 2] as described above, from the four or more toner patches P.

As shown in FIG. 10B, the controller 10 according to the first embodiment acts, when the processor executes the control program, as the density difference calculator 40, the current difference calculator 41, a second product calculator 50, a third product calculator 51, a third sum calculator 52, a fourth sum calculator 53, a fourth product calculator 54, a fifth sum calculator 55, a fifth product calculator 56, a third square calculator 57, and a second quotient calculator 58, when four or more toner patches P are provided.

The developing roller 321 develops n (n≥4) pieces of toner patches P, different in toner density M and in developing current I from one another, on the photoconductor drum 33.

The second product calculator 50 calculates a second product, by multiplying the toner density M by the developing current I, with respect to each of the n pieces of toner patches P The third product calculator 51 calculates a third product, by multiplying the sum of the second product by n. The third sum calculator 52 calculates a third sum, by summing up the toner density M of each of the n pieces of toner patches P The fourth sum calculator 53 calculates a fourth sum, by summing up the developing current I of each of the n pieces of toner patches P.

The fourth product calculator 54 calculates a fourth product, by multiplying the third sum by the fourth sum. The fifth sum calculator 55 calculates a fifth sum, by summing up the second square, which is the square of the toner density M of each of the n pieces of toner patches P. The fifth product calculator 56 calculates a fifth product, by multiplying the fifth sum by n. The third square calculator 57 calculates a third square, which is the square of the third sum. The second quotient calculator 58 calculates a second quotient, by dividing a first difference between the third product and the fourth product by a second difference between the fifth product and the third square.

In other words, the second quotient calculator 58 calculates the second quotient, indicating the inclination "a" ([Math. 2]) of the approximate straight line approximating the relation among n pieces of points plotted on the toner density/developing current plane, respectively representing the toner density M and the developing current I related to each of the n pieces of toner patches P.

Referring to FIG. 8, FIG. 9, and FIG. 10B, the calculation method of the inclination "a" of the approximate straight line, performed when four toner patches P are provided, will be described in detail hereunder.

The developing roller 321 develops the four toner patches P1, P2, P3, and P4, different in toner density M and in developing current I from one another, on the photoconductor drum 33.

The controller 10 calculates the approximate straight line indicating the relation between the toner density M and the developing current I (I=aM+b), on the basis of the four toner patches P1, P2, P3, and P4. The controller 10 determines the inclination "a" of the approximate straight line, using [Math. 2]. [Math. 2] may be stored in advance in the storage device 7.

Numerator of [Math. 2]

The second product calculator 50 calculates the second product, by multiplying the toner density M by the developing current I, with respect to each of the four toner patches P1, P2, P3, and P4.

More specifically, the second product calculator 50 calculates as follows:

Second product=(toner density $M1$×developing current $I1$)

Second product=(toner density $M2$×developing current $I2$)

Second product=(toner density $M3$×developing current $I3$)

Second product=(toner density $M4$×developing current $I4$)

The third product calculator 51 calculates the third product, by multiplying the sum of the second product by four.

In other words, the third product calculator 51 calculates as:

Third product=4×(sum of second product)

More specifically, the third product calculator 51 calculates as follows:

Third product=4×(toner density$M1$×developing current$I1$+toner density$M2$×developing currentI2+toner density$M3$×developing currentI3+toner density$M4$×developing current$I4$)

The third sum calculator 52 calculates the third sum, by summing up the toner density M of each of the four toner patches P1, P2, P3, and P4. More specifically, the third sum calculator 52 calculates as follows:

Third sum=(toner density$M1$+toner density$M2$+toner density$M3$+toner density $M4$)

The fourth sum calculator 53 calculates the fourth sum, by summing up the developing current I of each of the four toner patches P1, P2, P3, and P4. More specifically, the fourth sum calculator 53 calculates as follows:

Fourth sum=(developing current$I1$+developing current$I2$+developing current$I3$+developing current$I4$)

The fourth product calculator 54 calculates the fourth product by multiplying the third sum by the fourth sum. In other words, the fourth product calculator 54 calculates as:

Fourth product=(third sum×fourth sum)

More specifically, the fourth product calculator 54 calculates as follows:

Fourth product=(toner density $M1$+toner density $M2$+toner density $M3$+toner density $M4$)×(developing current $I1$+developing current $I2$+developing current13+developing current $I4$)

The second quotient calculator 58 calculates the first difference as:

First difference=(third product−fourth product)

More specifically, the second quotient calculator 58 calculates as follows:

First difference=4×(toner density $M1$×developing current $I1$+toner density$M2$×developing current$I2$+toner density$M3$×developing current$I3$+toner density$M4$×developing current$I4$)−(toner density$M1$+toner density$M2$+toner density$M3$+toner density$M4$)×(developing current$I1$+developing current$I2$+developing current$I3$+developing current$I4$)

Denominator of [Math. 2]

The fifth sum calculator 55 calculates the fifth sum, by summing up the second square of the toner density M, of each of the four toner patches P1, P2, P3, and P4.

More specifically, the fifth sum calculator 55 calculates four values of the second square, as expressed hereunder.

Second square=toner density$M1^2$

Second square=toner density$M2^2$

Second square=toner density$M3^2$

Second square=toner density$M4^2$

Then the fifth sum calculator 55 calculates the fifth sum by summing up the four values of the second square as:

Fifth sum=(toner density$M1^{2+}$ toner density$M2^{2+}$ toner density$M3^{2+}$ toner density$M4^2$)

The fifth product calculator 56 calculates the fifth product as:

Fifth product=4×(fifth sum)

More specifically, the fifth product calculator 56 calculates as follows:

Fifth product=4×(toner density$M1^{2+}$ toner density$M2^{2+}$ toner density$M3^{2+}$ toner density$M4^2$)

The third square calculator 57 calculates the third square of the third sum, as:

Third square=(third sum)$^2$

To be more detailed, the third square calculator 57 calculates as follows:

Third square=(toner density$M1$+toner density$M2$+toner density$M3$+toner density$M4$)$^2$ The second quotient calculator 58 calculates the second difference as:

Second difference=(fifth product−third square)

More specifically, the second quotient calculator 58 calculates as follows:

Second difference=4×(toner density$M1^{2+}$ toner density$M2^{2+}$ toner density$M3^{2+}$ toner density$M4^2$)−(toner density$M1$+toner density$M2$+toner density$M3$+toner density$M4$)$^2$ The second quotient calculator 58 calculates the second quotient, by dividing the first difference between the third product and the fourth product by the second difference between the fifth product and the third square.

In other words, the second quotient calculator 58 calculates as:

Second quotient=(first difference/second difference)

More specifically, the second quotient calculator 58 calculates as follows:

Second quotient=[4×(toner density$M1$×developing current$I1$+toner density$M2$×developing current$I2$+toner density$M3$×developing current$I3$+toner density$M4$×developing current$I4$)−(toner density$M1$+toner density$M2$+toner density$M3$+toner density$M4$)×(developing current$I1$+developing current$I2$+developing current$I3$+developing current$I4$)]/[4×(toner density$M1^{2+}$ toner density$M2^{2+}$ toner density$M3^{2+}$ toner density$M4^2$)−(toner density$M1$+toner density$M2$+toner density$M3$+toner density$M4$)$^2$1]

Thus, the second quotient calculator 58 calculates the second quotient, indicating the inclination "a" of the approximate straight line approximating the relation among the four points plotted on the toner density/developing current plane, respectively representing the toner density M1 to M4 and the developing current I1 to 14 related to the four toner patches P1, P2, P3, and P4.

With the arrangement according to the first embodiment, the inclination "a" of the approximate straight line, indicating the relation of the developing current I to the toner density M, can be calculated, using the four toner patches P1, P2, P3, and P4.

Comparison Between [Math. 1] and [Math. 2]

Hereunder, the significance or advantageous effects of using one of the mathematical expressions will be described, through comparison between the cases of using [Math. 1] and using [Math. 2], in the first embodiment.

The number of times of calculation (or calculation amount) Ncal performed by the controller 10, when [Math. 1] includes n pieces of data, is calculated. The number of combinations of subscripts i and j corresponds to the number of combinations of two numerals different from each other, selected from the n pieces of data. Accordingly, regarding the number of times of calculation with respect to each item of the denominator of [Math. 1], the controller 10 calculates the sum (${}_nC_2$−1) times, the difference in toner density M ${}_nC_2$ times, and the square of the difference ${}_nC_2$ times.

Regarding the number of times of calculation with respect to each item of the numerator of [Math. 1], the controller 10 calculates the sum (${}_nC_2$−1) times, the toner density M zero times since this has already been calculated in the denominator, the difference in developing current I ${}_nC_2$ times, and the product of the difference in toner density M and the difference in developing current I, ${}_nC_2$ times. The controller 10 also divides the numerator by the denominator, once. Therefore, the total number of times of calculation of [Math. 1] becomes (6${}_nC_2$−1) times.

Since it is known that ${}_nC_2$ equals to ($n^2/2-n/2$), the number of times of calculation Ncal of [Math. 1] can be expressed as [Math. 4] cited below. [Math. 4] includes an item representing the square of the number of pieces of data n. Accordingly, when the number of pieces of data n increases, the number of times of calculation Ncal increases in the order of O($n^2$), in other words as a quadratic equation, which leads to an increase in the number of times of calculation Ncal (calculation time).

[Math. 4]

$$N_{cal}=3n^2-3n-1 \ldots \quad (4)$$

Then, the number of times of calculation (or calculation amount) Ncal performed by the controller 10, when [Math. 2] includes n pieces of data, is calculated. Regarding the number of times of calculation with respect to each item of the denominator of [Math. 2], the controller 10 calculates the square of M n times, sums up the square of M (n−1) times, multiples the number of pieces of data n once, sums up M n times, calculates the square of the sum once, and performs subtraction once.

Regarding the number of times of calculation with respect to each item of the numerator of [Math. 2], the controller 10 multiplies M by I n times, sums up the product (n−1) times, multiplies by the number of pieces of data n once, sums up M zero times since this has already been calculated in the denominator, sums up I (n−1) times, and performs subtraction once. In addition, the controller 10 divides the numerator by the denominator once.

Therefore, the number of times of calculation Ncal of [Math. 2] can be expressed as [Math. 5] cited below. As is apparent from [Math. 5], the number of times of calculation Ncal of [Math. 2] is expressed in the order of O(n), in other words as a linear equation.

[Math. 5]

$$N_{cal}=6n+3 \ldots \quad (5)$$

As described above, the number of times of calculation Ncal based on [Math. 1] is expressed by [Math. 4], and the number of times of calculation Ncal based on [Math. 2] is expressed by [Math. 5]. When the number of pieces of data n is large, the number of times of calculation Ncal based on [Math. 2] ([Math. 5]) is significantly reduced, compared with the number of times of calculation Ncal based on [Math. 1] ([Math. 4]). The larger the number of piece of data n becomes, the larger benefit can be attained.

However, when n is 3, the number of times of calculation Ncal according to [Math. 4] becomes 17, and the number of times of calculation Ncal according to [Math. 5] becomes 21. Therefore, when n is 3, [Math. 1] requires fewer times of calculation Ncal, than [Math. 2].

On the other hand, when n is 4, the number of times of calculation Ncal according to [Math. 4] becomes 35, and the number of times of calculation Ncal according to [Math. 5] becomes 27. Therefore, when n is 4, [Math. 2] requires fewer times of calculation Ncal, than [Math. 1]. This also applies, when n is equal to or larger than 5. Thus, the difference in the number of times of calculation Ncal between [Math. 4] and [Math. 5] becomes larger, when n exceeds 4, and as the value of n becomes larger therefrom.

Figure 12:
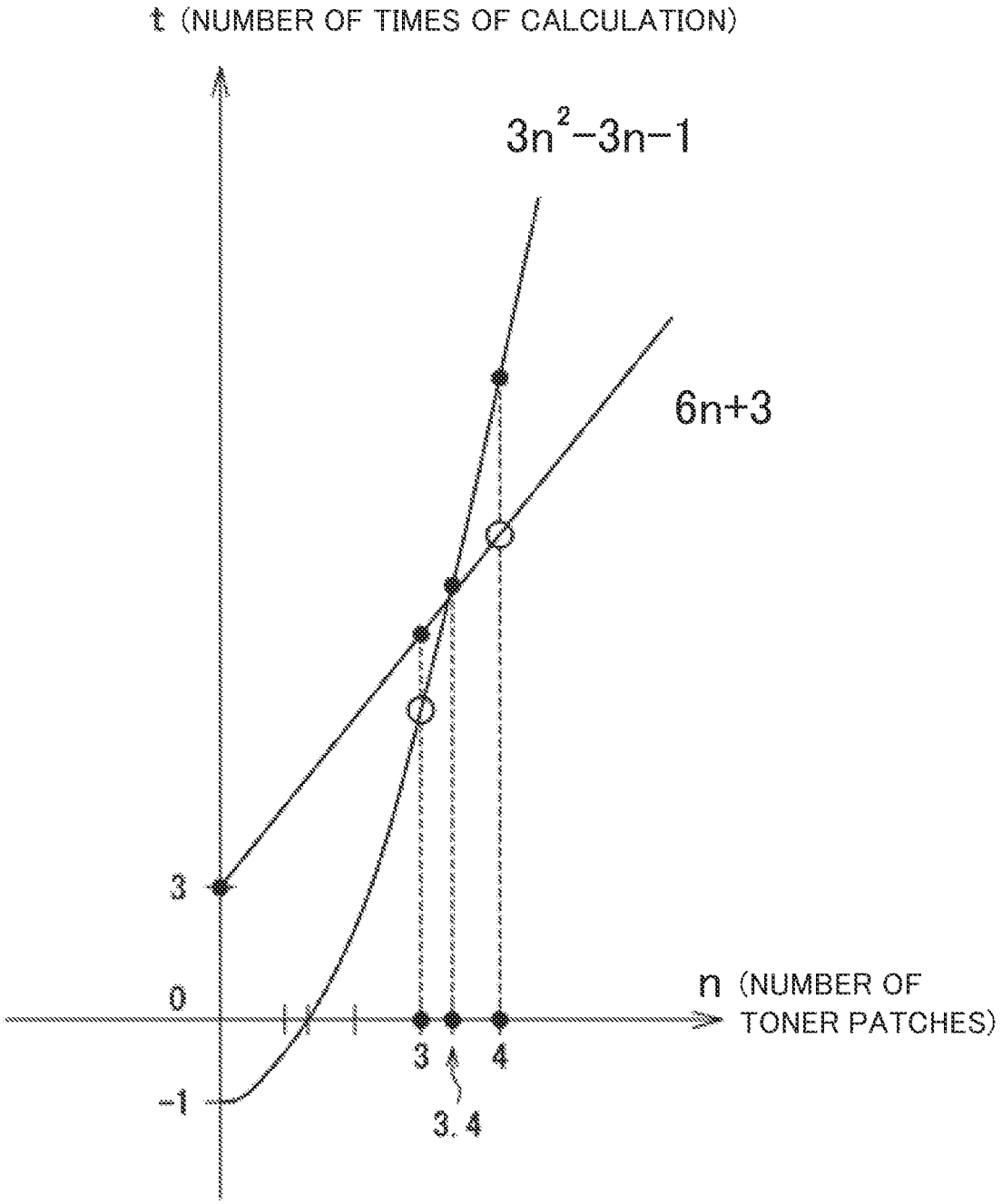
FIG. 12 is a graph showing relations between the number of toner patches and the number of times of calculation or calculation amount, by the controller.

Referring to FIG. 12, the comparison between [Math. 1] and [Math. 2] will be described further. FIG. 12 is a graph having the horizontal axis representing the number of toner patches P n, and the vertical axis representing the number of times of calculation Ncal.

As shown in FIG. 12, since the number of times of calculation Ncal of [Math. 1] is expressed in the order of $O(n^2)$ (quadratic equation) as indicated by [Math. 4], the number of times of calculation Ncal of [Math. 1] can be expressed as a quadratic function of n. Since the number of times of calculation Ncal of [Math. 2] is expressed in the order of O(n) (linear equation) as indicated by [Math. 5], the number of times of calculation Ncal of [Math. 2] can be expressed as a linear function of n.

[Math. 4] and [Math. 5] intersect with each other, when n is nearly equal to 3.4. Accordingly, around 3.4 as a branch point, the number of times of calculation Ncal of [Math. 4] becomes fewer than the number of times of calculation Ncal of [Math. 5], when n is 3. In contrast, when n is equal to or larger than 4, the number of times of calculation Ncal of [Math. 5] becomes fewer than the number of times of calculation Ncal of [Math. 4].

According to the first embodiment, therefore, the controller 10 calculates the inclination "a" of the approximate straight line using [Math. 1], when three toner patches P are provided. As result, the number of times of calculation Ncal becomes fewest, and the calculation amount or calculation time can be reduced.

When four or more toner patches P are provided, the controller 10 calculates the inclination "a" of the approximate straight line using [Math. 2]. As result, the number of times of calculation Ncal becomes fewest, and the calculation amount or calculation time can be reduced.

Second Embodiment

Figure 11:
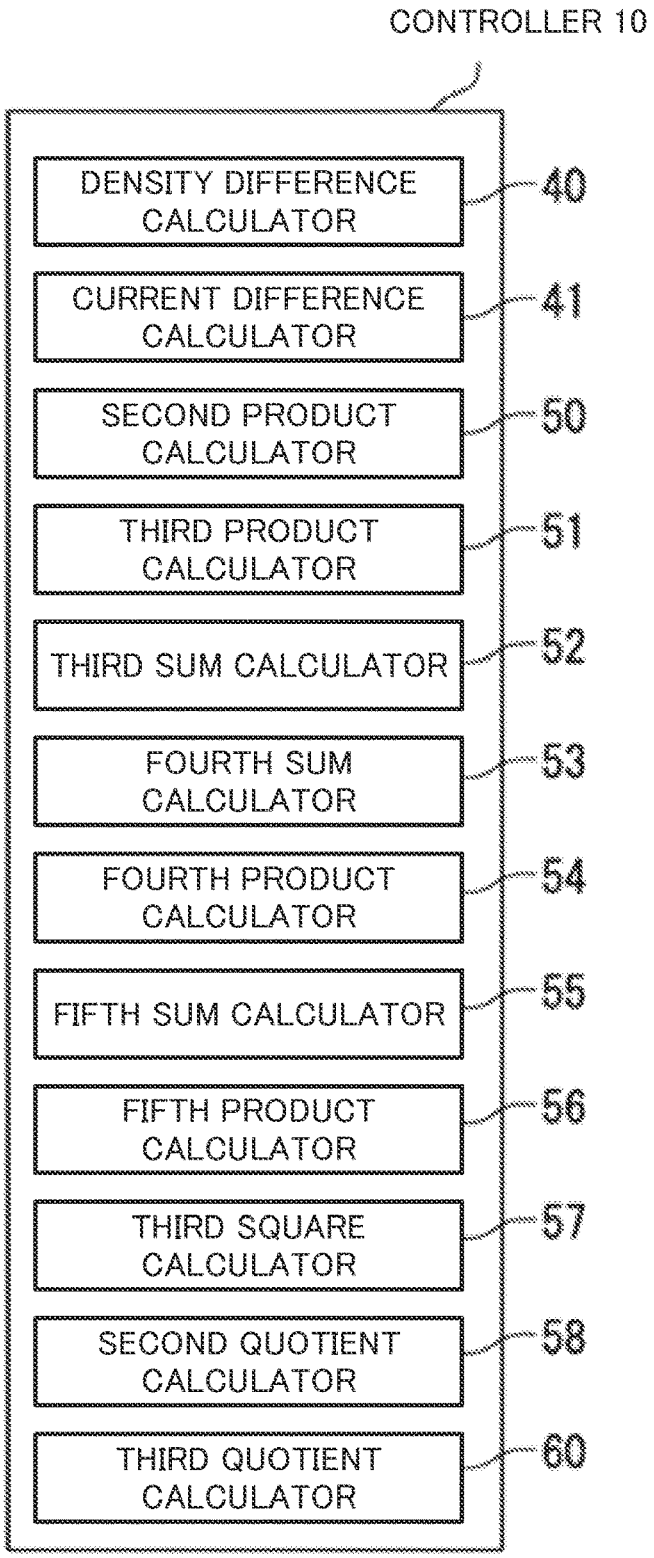
FIG. 11 is a block diagram showing a configuration of a controller according to a second embodiment.

Referring now to FIG. 11, the image forming apparatus 100 will be described hereunder. As shown in FIG. 11, the image forming apparatus 100 according to the second embodiment is configured similarly to the image forming apparatus 100 according to the first embodiment, except that the controller 10 further acts as a third quotient calculator 60, when four or more toner patches P are provided. The description of the same elements as those of the first embodiment will not be repeated.

When the number of toner patches P n is equal to or larger than 4, the third quotient calculator 60 calculates a third quotient, by dividing a third difference between the fourth sum and n times of the second quotient by the third sum. The second quotient indicates the developing current segment b of the approximate straight line, approximating the relation among n pieces of points plotted on the toner density/developing current plane, respectively representing the toner density M and the developing current I related to each of the n pieces of toner patches P The third quotient indicates the inclination "a" of such approximate straight line.

In the first embodiment, the controller 10 calculates the inclination "a" using [Math. 2], when the number of toner patches P n is equal to or larger than 4.

In the second embodiment, in contrast, the controller 10 calculates the inclination "a" using [Math. 6] and [Math. 7] cited below, when the number of toner patches P n is equal to or larger than 4. As result, the number of times of calculation Ncal becomes fewer, and the calculation amount or calculation time can be reduced.

[Math. 6] (6)

$$b = \frac{n\sum_{k=1}^{n} M_k I_k - \sum_{k=1}^{n} M_k \sum_{k=1}^{n} I_k}{n\sum_{k=1}^{n} M_k^2 - \left(\sum_{k=1}^{n} M_k\right)^2}$$

[Math. 7] (7)

$$a = \frac{\sum_{k=1}^{n} I_k - nb}{\sum_{k=1}^{n} M_k}$$

The third quotient calculator 60 calculates the inclination "a" of the approximate straight line, approximating the relation among n pieces of points plotted on the toner density/developing current plane, respectively representing the toner density M and the developing current I related to each of the n pieces of toner patches P, using the fourth sum calculated by the fourth sum calculator 53, the second quotient calculated by the second quotient calculator 58, and the third sum calculated by the third sum calculator 52.

As indicated by [Math. 7], the third quotient calculator 60 utilizes the developing current segment b of the approximate straight line, to calculate the inclination "a".

Accordingly, the third quotient calculator 60 first uses [Math. 6] to calculate the developing current segment b of the approximate straight line. The developing current segment b is equal to the second quotient calculated by the second quotient calculator 58 in the first embodiment.

Then the third quotient calculator 60 calculates the third difference, between the fourth sum calculated by the fourth sum calculator 53 and n times of the second quotient. In other words, the third quotient calculator 60 calculates as:

Third difference=(fourth sum−*n*×second quotient)

The third quotient calculator 60 calculates the third quotient, by dividing the third difference by the third sum calculated by the third sum calculator 52. In other words, the third quotient calculator 60 calculates as:

Third quotient=(third difference/third sum)

Hereunder, the number of times of calculation Ncal, performed by the third quotient calculator 60 when calculating the inclination "a" of the approximate straight line using [Math. 6] and [Math. 7], will be described.

The number of times of calculation or calculation amount of [Math. 6] is equal to that of [Math. 2]. In other words, the number of times of calculation Ncal of [Math. 6] can be expressed by [Math. 5].

Regarding the number of times of calculation with respect to each item of the numerator of [Math. 7], the controller 10 multiplies [Math. 6] by n once, and performs subtraction once. Since the denominator has already been calculated in [Math. 6], the number of times of calculation is zero. The controller 10 further divides the numerator by the denominator once. Thus, the total number of times of calculation for the mentioned operation is three times. Therefore, the number of times of calculation Ncal of [Math. 7] can be expressed as [Math. 8] cited below, which is larger than [Math. 5] by 3. Since the number of times of calculation Ncal of [Math. 8] is expressed in the order of O(n) (linear equation), the result is substantially the same as [Math. 5].

[Math. 8]

$$Ncal=6n+6 \ldots \quad (8)$$

When n is 3, the number of times of calculation Ncal of [Math. 4] becomes 17, and the number of times of calculation Ncal of [Math. 8] becomes 24. Therefore, when n is 3, the number of times of calculation Ncal becomes fewer when the controller 10 uses [Math. 1], than when the controller 10 uses [Math. 7].

When n is 4, in contrast, the number of times of calculation Ncal of [Math. 4] becomes 35, and the number of times of calculation Ncal of [Math. 8] becomes 30. Therefore, when n is 4, the number of times of calculation Ncal becomes fewer when the controller 10 uses [Math. 7], than when the controller 10 uses [Math. 1]. This also applies, when n is equal to or larger than 5. Thus, the number of times of calculation Ncal of [Math. 8] becomes still fewer than that of [Math. 4], with the increase of n from 4.

With the arrangement according to the second embodiment, therefore, the number of times of calculation Ncal becomes fewest, and the calculation amount or calculation time can be reduced, when the controller 10 calculates the inclination "a" of the approximate straight line using [Math. 1], with respect to three toner patches P.

In the case where four or more toner patches P are provided, the number of times of calculation Ncal becomes fewest, and the calculation amount or calculation time can be reduced, when the controller 10 calculates the inclination "a" of the approximate straight line using [Math. 6] and [Math. 7].

Figure 13:
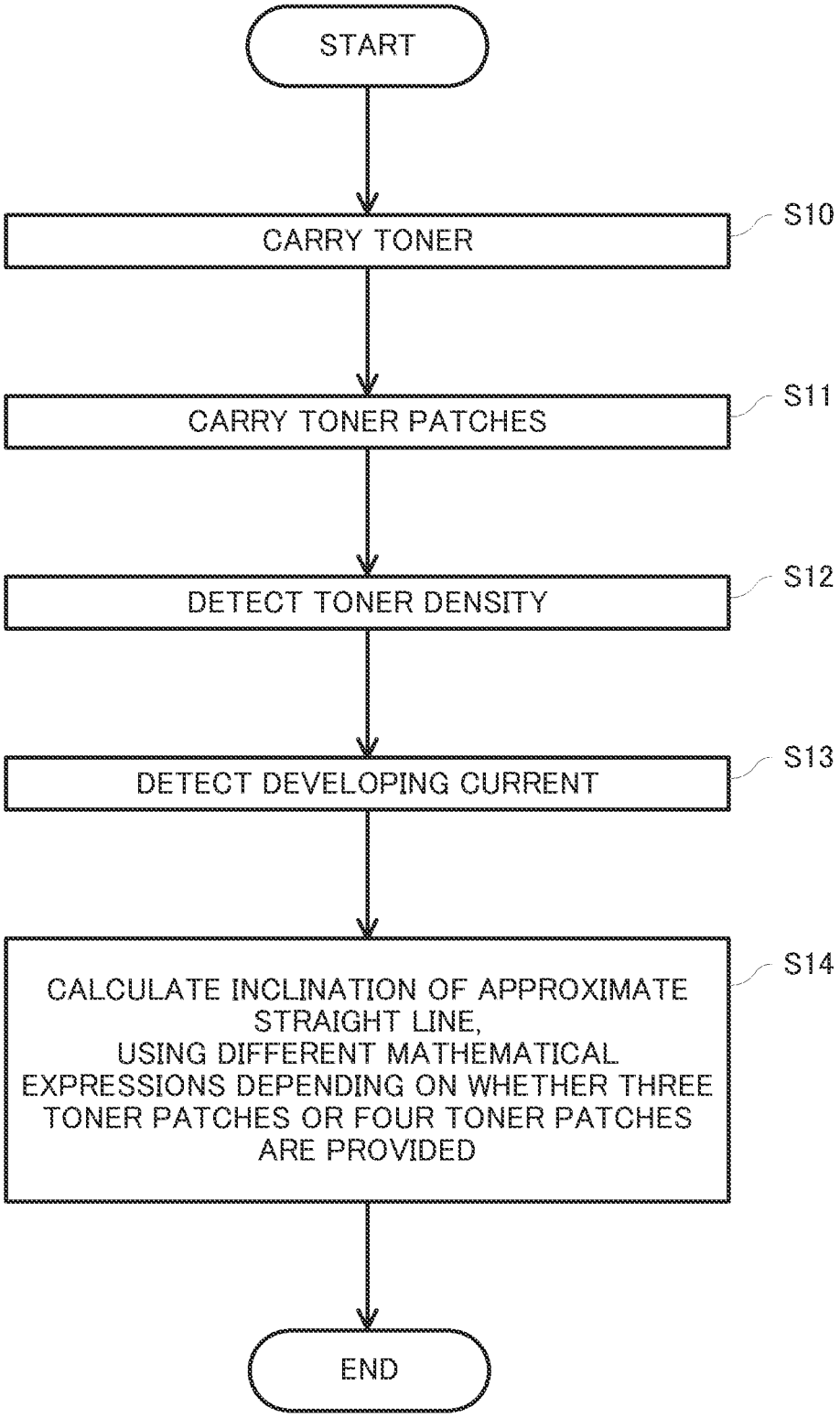
FIG. 13 is a flowchart showing an inclination calculation process.

Referring now to FIG. 13, an inclination calculation process according to the first embodiment will be described hereunder. FIG. 13 is a flowchart showing the inclination calculation process according to the first embodiment.

As shown in FIG. 13, the inclination calculation process according to the first embodiment includes step S10 to step S14, each of which will be sequentially described hereunder.

F As shown in FIG. 13, the developing roller 321 carries the toner T (step S10).

After step S10, the photoconductor drum 33 carries the toner patches P, on each of which the electrostatic latent image has been developed with the toner T carried by the developing roller 321 (step S11).

After step S11, the density detector 322 detects the toner density M of the toner patch P (step S12).

After step S12, the current detector 323 detects the developing current I flowing to the toner patch P (step S13).

After step S13, the controller 10 calculates the inclination "a" of the approximate straight line, using different mathematical expressions depending on whether three toner patches P or four or more toner patches P are provided (step S14). Hereinafter, the operation performed at step S14 when three toner patches P are provided will be referred to as first calculation process, and the operation performed when four or more toner patches P are provided will be referred to as second calculation process.

Figure 14:
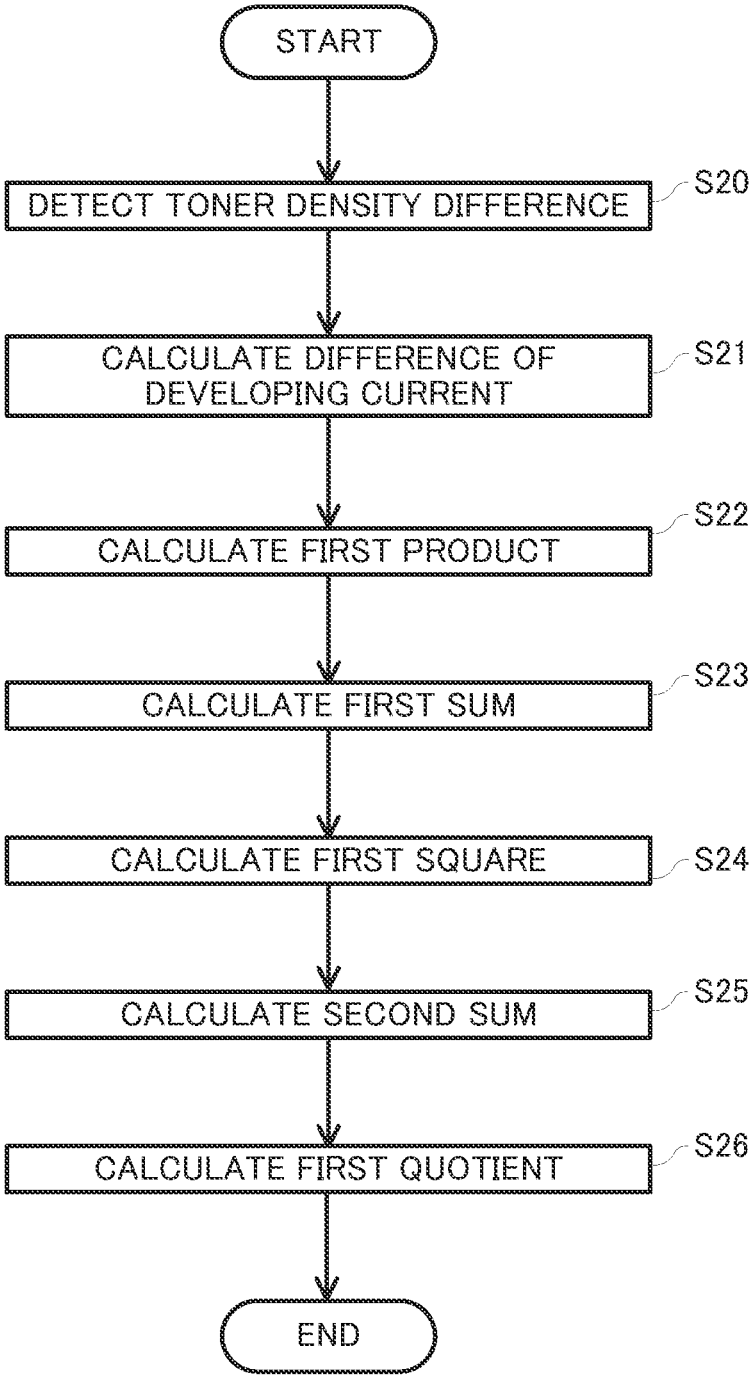
FIG. 14 is a flowchart showing an example of a first calculation process.
Figure 15:
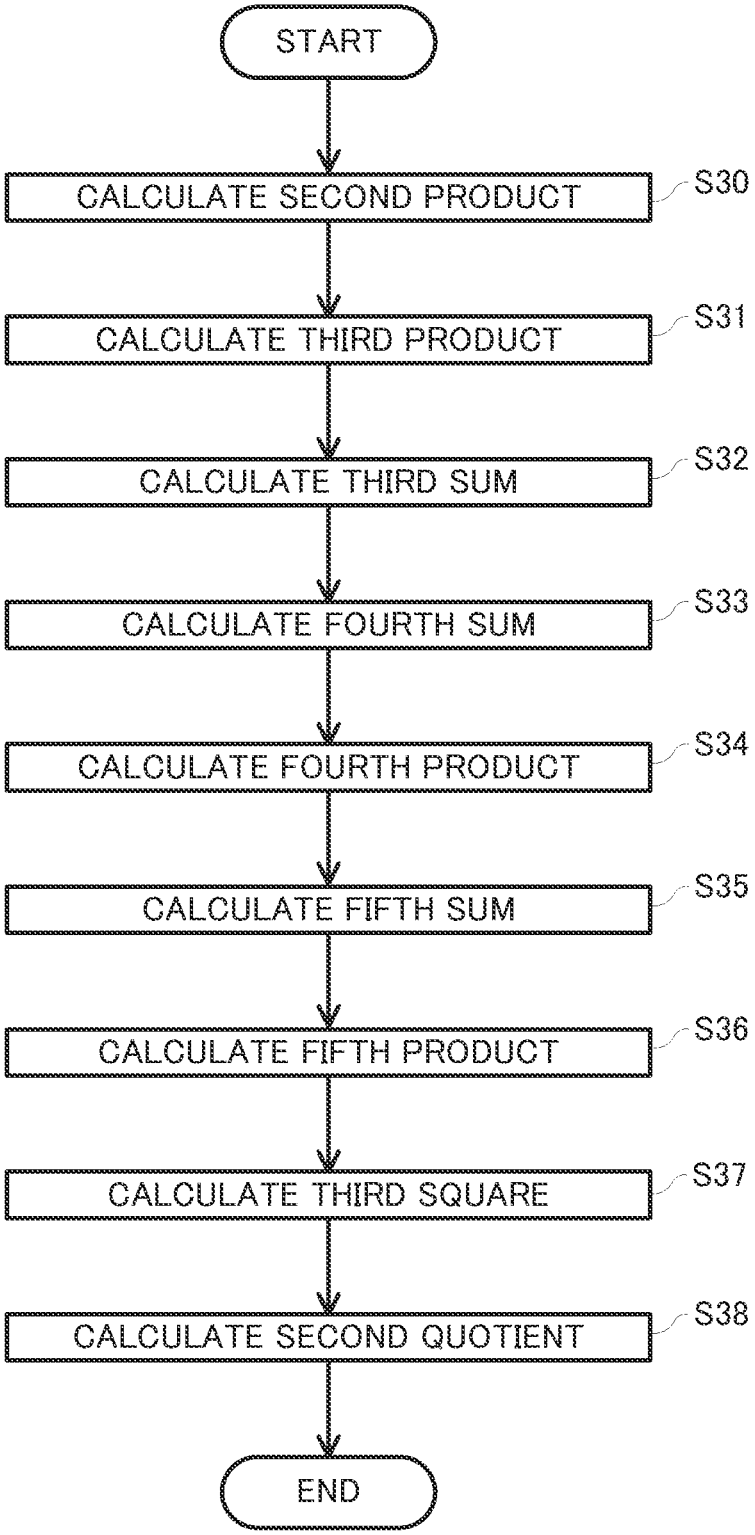
FIG. 15 is a flowchart showing an example of a second calculation process.

Referring to FIG. 14 and FIG. 15, the operation at step S14 will be described in detail. FIG. 14 is a flowchart showing an example of the first calculation process. FIG. 15 is a flowchart showing an example of the second calculation process.

First Calculation Process

As shown in FIG. 14, the first calculation process includes step S20 to step S26, each of which will be sequentially described hereunder.

The density difference calculator 40 calculates the toner density difference, with respect to each of the combinations of two toner patches P, out of the three toner patches P (step S20).

After step S20, the current difference calculator 41 calculates the current difference of the developing current I, with respect to each of the combinations of the two toner patches P (step S21).

After step S21, the first product calculator 42 calculates the first product, by multiplying the toner density difference by the current difference, with respect to each of the combinations of the toner density difference and the current difference, calculated from each of the combinations of the two toner patches P (step S22).

After step S22, the first sum calculator 43 calculates the first sum, by summing up the three values of the first product calculated as above (step S23).

After step S23, the first square calculator 44 calculates the first square indicating the square of the toner density difference, with respect to each of the combinations of the two toner patches P (step S24).

After step S24, the second sum calculator 45 calculates the second sum, by summing up the three values of the first square calculated as above (step S25).

After step S25, the first quotient calculator 46 calculates the first quotient, by dividing the first sum by the second sum (step S26).

Second Calculation Process

As shown in FIG. 15, the second calculation process includes step S30 to step S38, each of which will be sequentially described hereunder.

The second product calculator 50 calculates the second product, by multiplying the toner density M by the developing current I, with respect to each of the n (n≥4) pieces of toner patches P (step S30).

After step S30, the third product calculator 51 calculates the third product, by multiplying the sum of the second product by n (step S31).

After step S31, the third sum calculator 52 calculates the third sum, by summing up the toner density M of each of the n pieces of toner patches P (step S32).

After step S32, the fourth sum calculator 53 calculates the fourth sum, by summing up the developing current I of each of the n pieces of toner patches P (step S33).

After step S33, the fourth product calculator 54 calculates the fourth product, by multiplying the third sum by the fourth sum (step S34).

After step S34, the fifth sum calculator 55 calculates the fifth sum, by summing up the second square of the toner density M, of each of the n pieces of toner patches P (step S35).

After step S35, the fifth product calculator 56 calculates the fifth product, by multiplying the fifth sum by n (step S36).

After step S36, the third square calculator 57 calculates the third square of the third sum (step S37).

After step S37, the second quotient calculator 58 calculates the second quotient (step S38).

Figure 16:
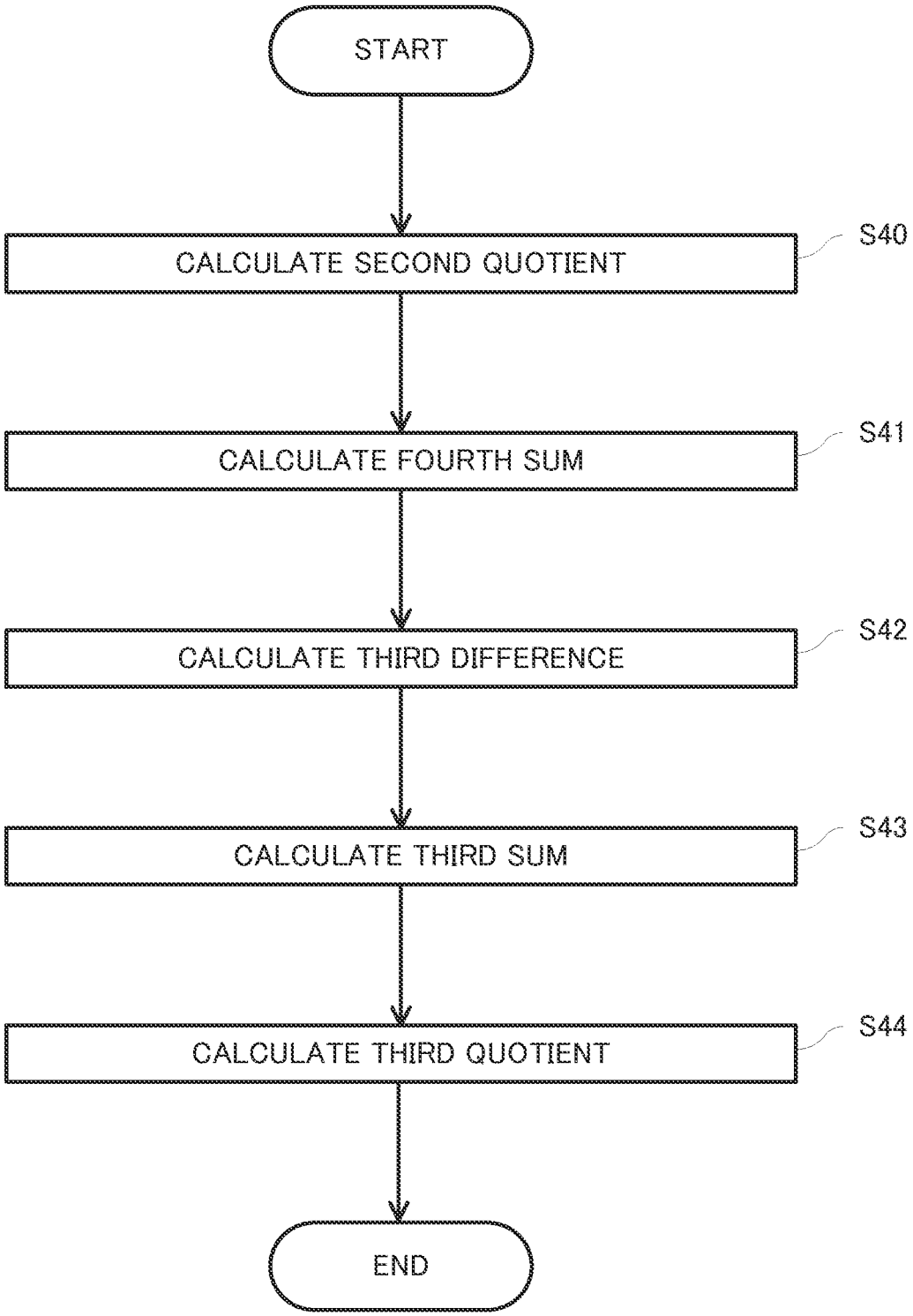
FIG. 16 is a flowchart showing an example of a third calculation process.

Referring to FIG. 16, a third calculation process according to the second embodiment will be described hereunder. FIG. 16 is a flowchart showing an example of the third calculation process.

As shown in FIG. 16, the third calculation process according to the second embodiment includes step S40 to step S45, each of which will be sequentially described hereunder.

The second quotient calculator 58 calculates the second quotient, by dividing the first difference between the second product and the third product by the second difference between the fifth sum and the third square (step S40).

After step S40, the fourth sum calculator 53 calculates the fourth sum (step S41).

After step S41, the third quotient calculator 60 calculates the third difference between the fourth sum and n times of the second quotient (step S42).

After step S42, the third sum calculator 52 calculates the third sum (step S43).

After step S43, the third quotient calculator 60 calculates the third quotient, by dividing the third difference by the third sum (step S44).

The embodiments of the disclosure have been described as above, with reference to the drawings. However, the disclosure is not limited to the foregoing embodiments, but may be implemented in various manners without departing from the scope of the disclosure. The drawings schematically illustrate the essential elements for the sake of ease in understanding, and the thickness, length, or the number of pieces of the illustrated elements may be different from the actual ones. Further, the material, shape, or size of the elements referred to in the foregoing embodiments are merely exemplary, and may be modified as desired, without substantially compromising the benefits provided by the disclosure.

INDUSTRIAL APPLICABILITY

The disclosure is applicable to the field of image forming apparatuses.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a developing roller that carries a toner;

a photoconductor drum that carries a toner patch on which an electrostatic latent image has been developed with the toner carried by the developing roller;

a density detector that detects toner density of the toner patch;

a current detector that detects developing current flowing to the toner patch; and a controller including a processor, and configured to calculate, when the processor executes a control program, an inclination of an approximate straight line approximating a relation between the toner density and the developing current, wherein the developing roller develops three or more toner patches, different in toner density and different in developing current from one another, on the photoconductor drum, and the controller calculates the inclination, using different mathematical expressions depending on whether three toner patches or four or more toner patches are provided.

2. The image forming apparatus according to claim 1, wherein the developing roller develops three toner patches, different in the toner density and different in the developing current from one another, on the photoconductor drum, and the controller acts as:

a density difference calculator that calculates a toner density difference with respect to each of combinations of two toner patches out of the three toner patches;

a current difference calculator that calculates a current difference of the developing current, with respect to each of the combinations of the two toner patches;

a first product calculator that calculates a first product by multiplying the toner density difference by the current difference, with respect to each of combinations of the toner density difference and the current difference, calculated from each of the combinations of the two toner patches;

a first sum calculator that calculates a first sum by summing up three calculated values of the first product;

a first square calculator that calculates a first square of the toner density difference, with respect to each of the combinations of the two toner patches;

a second sum calculator that calculates a second sum by summing up three calculated values of the first square; and a first quotient calculator that calculates a first quotient by dividing the first sum by the second sum, as the inclination defined when the three toner patches are provided.

3. The image forming apparatus according to claim 2, wherein the first quotient calculator calculates the first quotient, indicating the inclination of the approximate straight line approximating a relation among three points plotted on a toner density/developing current plane, respectively representing the toner density and the developing current of the three toner patches.

4. The image forming apparatus according to claim 1, wherein the developing roller develops n ($n \geq 4$) pieces of toner patches, different in the toner density and different in the developing current from one another, on the photoconductor drum, and the controller acts as:

a second product calculator that calculates a second product by multiplying the toner density by the developing current, with respect to each of the n pieces of toner patches;

a third product calculator that calculates a third product by multiplying a sum of the second product by n;

a third sum calculator that calculates a third sum by summing up the toner density of each of the n pieces of toner patches;

a fourth sum calculator that calculates a fourth sum by summing up the developing current of each of the n pieces of toner patches;

a fourth product calculator that calculates a fourth product by multiplying the third sum by the fourth sum;

a fifth sum calculator that calculates a fifth sum by summing up a second square of the toner density of each of the n pieces of toner patches;

a fifth product calculator that calculates a fifth product by multiplying the fifth sum by n;

a third square calculator that calculates a third square of the third sum; and a second quotient calculator that calculates a second quotient by dividing first difference between the third product and the fourth product by a second difference between the fifth product and the third square, as the inclination defined when the four or more toner patches are provided.

5. The image forming apparatus according to claim 4, wherein the second quotient calculator calculates the second quotient, indicating the inclination of the approximate straight line approximating a relation among n pieces of points plotted on a toner density/developing current plane, respectively representing the toner density and the developing current of the n pieces of toner patches.

6. The image forming apparatus according to claim 4, wherein the controller further acts as a third quotient calculator that calculates a third quotient by dividing a third difference between the fourth sum and n times of the second quotient by the third sum, when n is equal to or larger than four, the second quotient calculator calculates the second quotient, indicating a developing current segment of the approximate straight line, approximating a relation among n pieces of points plotted on a toner density/developing current plane, respectively representing the toner density and the developing current of the n pieces of toner patches, and the third quotient calculator calculates the third quotient indicating the inclination of the approximate straight line.

7. The image forming apparatus according to claim 1, wherein the controller adjusts a developing bias voltage to be applied to the developing roller, according to the calculated inclination of the approximate straight line.

* * * * *